US008585421B2

(12) United States Patent
Yamaguchi et al.

(10) Patent No.: US 8,585,421 B2
(45) Date of Patent: Nov. 19, 2013

(54) CONNECTOR

(75) Inventors: Yasuhiro Yamaguchi, Shizuoka (JP); Nobuaki Yoshioka, Shizuoka (JP); Sakai Yagi, Shizuoka (JP); Sachiko Yagome, Shizuoka (JP); Hiroshi Kawano, Shizuoka (JP); Yuichiro Matsumoto, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/258,271

(22) PCT Filed: Mar. 5, 2010

(86) PCT No.: PCT/JP2010/053625

§ 371 (c)(1),
(2), (4) Date: Sep. 21, 2011

(87) PCT Pub. No.: WO2010/110032

PCT Pub. Date: Sep. 30, 2010

(65) Prior Publication Data

US 2012/0015546 A1 Jan. 19, 2012

(30) Foreign Application Priority Data

| | | |
|---|---|---|
| Mar. 25, 2009 | (JP) | 2009-073127 |
| Jun. 26, 2009 | (JP) | 2009-151788 |
| Jul. 3, 2009 | (JP) | 2009-158511 |
| Aug. 6, 2009 | (JP) | 2009-183151 |

(51) Int. Cl.
*H01R 13/64* (2006.01)

(52) U.S. Cl.
USPC ..... 439/248

(58) Field of Classification Search
USPC ..... 439/247, 248
See application file for complete search history.

(56) References Cited

U.S. PATENT DOCUMENTS

| | | | | |
|---|---|---|---|---|
| 3,964,814 | A * | 6/1976 | Kalbitz et al. | 439/248 |
| 4,351,582 | A | 9/1982 | Emerson et al. | |
| 4,738,631 | A * | 4/1988 | Takahashi et al. | 439/248 |

(Continued)

FOREIGN PATENT DOCUMENTS

| | | | |
|---|---|---|---|
| JP | 11265755 | A | 9/1999 |
| JP | 2000150071 | A | 5/2000 |

(Continued)

OTHER PUBLICATIONS

International Search Report for PCT/JP2010/053625 issued Mar. 5, 2010.

(Continued)

*Primary Examiner* — Gary F. Paumen
(74) *Attorney, Agent, or Firm* — Edwards Wildman Palmer LLP

(57) ABSTRACT

A connector 1 includes: a terminal 2; an inner housing 5; and an outer housing 30 receiving the terminal 2 and the inner housing 5. The terminal 2 is provided with a first electric connecting part 21 received and held in the inner housing 5 and electrically connected to the mating connector, a second electric connecting part 22, and a flexible coupling part 23 made of conductive material, movably coupling and electrically connecting the first electric connecting part 21 and the second electric connecting part 22. The outer housing 30 is provided with a receiving part 36 movably receiving the inner housing 5 which receives the first electric connecting part 21, and a fixing part 35 to which the second electric connecting part 22 is fixed.

19 Claims, 22 Drawing Sheets

(56) References Cited

U.S. PATENT DOCUMENTS

| | | | | |
|---|---|---|---|---|
| 5,201,663 | A * | 4/1993 | Kikuchi et al. | 439/83 |
| 6,155,858 | A * | 12/2000 | Ozawa et al. | 439/248 |
| 7,422,456 | B1 | 9/2008 | Mitani et al. | |
| 7,749,010 | B2 * | 7/2010 | Takehara | 439/247 |
| 2002/0013079 | A1 * | 1/2002 | Yoshimatsu et al. | 439/247 |
| 2004/0166744 | A1 | 8/2004 | Inaba et al. | |

FOREIGN PATENT DOCUMENTS

| | | |
|---|---|---|
| JP | 2000-277217 | 6/2000 |
| JP | 2004-079206 A | 3/2004 |
| JP | 2005-129390 | 5/2005 |
| JP | 2008-262736 A | 10/2008 |
| JP | 2008-288120 A | 11/2008 |
| JP | 2008300329 A | 12/2008 |

OTHER PUBLICATIONS

Japanese Office Action mailed on Feb. 12, 2013 for corresponding Japanese Application No. 2009-073127.

Chinese Office Action issued on May 17, 2013 for corresponding Chinese Application No. 201080009718.7.

Japanese Office Action mailed on Jun. 4, 2013 for corresponding Japanese Application No. 2009-158511.

Japanese Office Action mailed on Jul. 2, 2013 for corresponding Japanese Application No. 2009-183151.

* cited by examiner

CONNECTOR

TECHNICAL FIELD

This invention relates to a connector including: a terminal; an inner housing receiving the terminal; and an outer housing receiving the terminal and the inner housing.

BACKGROUND ART

Various electronic devices are mounted on a vehicle. Conventionally, a wiring harness is used for electrically connecting the electronic devices to each other. The wiring harness is composed of a plurality of electric wires and a plurality of connectors attached to ends of the electric wires. Further, the connector is composed of a terminal and a housing receiving the terminal. When the connectors of the wiring harness are respectively fitted into connectors fixed to such as a case of the electronic devices, the electronic devices are electrically connected to each other.

In the aforementioned connector, sometimes a position gap is generated between the terminal of the connector and the terminal of the mating connector, so that the connector cannot be fitted into the mating connector. There is a terminal that can absorb the position gap with respect to the terminal of the mating connector, for example, a terminal disclosed in Patent Document 1. Further, there is a connector that can absorb the position gap with respect to the terminal of the mating connector, for example, a connector disclosed in Patent Document 2.

The terminal disclosed in the Patent Document 1 includes: a first female terminal part into which a first male terminal as "the mating terminal" is inserted; a second female terminal part into which a second male terminal as "the mating terminal" is inserted; and a coupling part coupling the first and second female terminal parts. A buffer part is provided on the coupling part, formed narrower or thinner than the other parts of the coupling part. In this terminal, when the buffer part is elastically deformed in a thickness direction, the first or the second female terminal part is moved in the thickness direction to absorb the position gap between the first male terminal and the first female terminal part, or the position gap between the second male terminal and the second female terminal part.

The connector disclosed in the Patent Document 2 includes: a terminal attached to an end of an electric wire; an inner housing receiving the terminal; an outer housing movably receiving the inner housing receiving the terminal; and a spring washer biasing the inner housing toward a mating connector. Further, a stopper is provided on an inner wall of the outer housing to prevent the inner housing from falling out of the outer housing. In this connector, when connecting to the mating connector, the spring washer is elastically deformed so that the terminal is electrically connected to the terminal of the mating connector, thereby, the inner housing receiving the terminal is moved in the outer housing to absorb the position gap between the terminal and the terminal of the mating connector. Further, when this connector is fitted into the mating connector, the spring washer absorbs an impact load applied to the inner housing, thereby the inner housing is prevented from being damaged.

Citation List

Patent Literature
Patent Document 1: JP, A, 2005-129390
Patent Document 2: JP, A, 2000-277217

SUMMARY OF THE INVENTION

Technical Problem

However, in the aforementioned terminal and connector, there is a problem described below.

In the terminal disclosed in the Patent Document 1, the first or second female terminal part is only moved in one direction, namely, the thickness direction of the buffer part. Therefore, there is a problem that the position gap between the terminals in a width direction of the buffer part, and the position gap between the terminals in an arranging direction of the first and second female terminal parts cannot be absorbed. Accordingly, there is a need for a connector that can absorb the position gap in any direction generated between the terminal and the mating terminal, namely, the position gap in all directions.

Meanwhile, in recent years, because of the cost and the assembling workability, the connectors attached to the cases of the electronic devices have been directly fitted to be electrically connected to each other without using the wiring harness. In this case, a large position gap is expected to generate between the terminal of the connector and the terminal of the mating connector. However, in the terminal disclosed in the Patent Document 1, the amount of the position gap absorption is small, and there is a problem that the connector cannot be used in the above described purpose. Further, in a case that the electronic devices are heavy, when the connectors attached to the electronic devices are directly fitted together, there is a problem that the connectors may be damaged by applying a large impact load to the connectors.

Further, in the connector disclosed in the Patent Document 2, as described above, a stopper is provided on an inner wall of the outer housing to prevent the inner housing from falling out of the outer housing. However, this stopper is assembled with the outer housing after the inner housing is received in the outer housing. Therefore, there is a problem that the number of components of the connector is increased, and a structure of the connector becomes complex. Further, in this connector, because strict dimension accuracy is required in the outer housing and the stopper, there is a problem that the cost of the connector is increased.

Further, in the connector disclosed in the Patent Document 2, the electric wire connected to the terminal is guided out of the outer housing via a through-hole provided on an inner bottom wall of the outer housing. Therefore, when fitting with the mating connector, the electric wire is largely inclined by inclining the inner housing. Therefore, there is a problem that connection reliability between the electric wire and a member electrically connected to the electric wire may be reduced.

The present invention focuses on the above-described problems, and a first object of the present invention is to provide a connector able to be surely fitted with a mating connector by absorbing a position gap generated between a terminal and a terminal of the mating connector when fitting with the mating connector. Further, a second object of the present invention is to provide a connector able to be further surely fitted with the mating connector by absorbing a position gap in all directions generated between a terminal and a terminal of a mating connector when fitting with the mating connector. Further, a third object of the present invention is to provide a connector able to be surely fitted with the mating connector by absorbing a position gap generated between a terminal and a terminal of a mating connector when fitting with the mating connector, and able to prevent the connector from being damaged by an impact generated when fitting with the mating connector. Further, a fourth object of the present invention is to provide a connector having a small number of components and a simple structure able to be surely fitted with the mating connector by absorbing a position gap generated between a terminal and a terminal of a mating connector when fitting with the mating connector, and able to prevent the connector from being damaged by an impact generated when fitting with the mating connector.

Solution to Problem

For attaining the first object, according to the invention described in claim 1, there is provided a connector comprising:

a terminal;

an inner housing; and an outer housing receiving the terminal and the inner housing, wherein the terminal is provided with a first electric connecting part received and held in the inner housing, and electrically connected to a mating connector, a second electric connecting part disposed further away from the mating connector than the first electric connecting part, and a coupling part made of conductive material, having flexibility or elasticity, and movably coupling and electrically connecting the first electric connecting part and the second connecting part, and wherein the outer housing is provided with a receiving part movably receiving the inner housing receiving the first electric connecting part, and a fixing part to which the second electric connecting part is fixed.

For attaining the second object, according to the invention described in claim 2, there is provided the connector claimed in claim 1, wherein the coupling part is composed of a braided wire.

For attaining the second object, according to the invention described in claim 3, there is provided the connector claimed in claim 1, wherein the coupling part is made by pressing a metal plate, formed elastically deformable in all directions, and composed of a first circular part attached to the first electric connecting part, a second circular part attached to the second electric connecting part, and a plurality of bow-shaped parts of which one end is continued to the first circular part, and the other end is continued to the second circular part and formed in a band shape, and of which intermediate part between the first and second circular parts is bend in a bow shape, and wherein because the coupling part is elastically deformed, the coupling part couples the first and second electric connecting parts movably in all directions.

For attaining the second object, according to the invention described in claim 4, there is provided the connector claimed in claim 1, wherein the coupling part is composed of a coil spring.

For attaining the third object, according to the invention described in claim 5, there is provided the connector claimed in any one of claims 1 to 4, further comprising: a biasing member interposed between the fixing part and the inner housing, and configured to bias the inner housing toward the mating connector.

For attaining the third object, according to the invention described in claim 6, there is provided the connector claimed in claim 5, wherein the biasing member is composed of a coil spring.

For attaining the third object, according to the invention described in claim 7, there is provided the connector claimed in claim 5, wherein, the biasing member is made of rubber, and formed in a tubular shape, and wherein the coupling member is positioned at an inside of the biasing member.

For attaining the third object, according to the invention described in claim 8, there is provided the connector claimed in any one of claims 1 to 7, further comprising: a tubular holder attached to an inside of the receiving part and configured to receive the inner housing.

For attaining the third object, according to the invention described in claim 9, there is provided the connector claimed in claim 8, wherein the holder is attached to the inside of the receiving part movably in a direction perpendicular to a fitting direction with the mating connector.

For attaining the third object, according to the invention described in claim 10, there is provided the connector claimed in claim 8 or claim 9, wherein a biasing part configured to bias the inner housing toward an inner side wall of the receiving part is provided on the holder.

For attaining the third object, according to the invention described in claim 11, there is provided the connector claimed in any one of claims 8 to 10, wherein a stopper configured to prevent the inner housing from falling out of the receiving part is provided on the holder.

For attaining the third object, according to the invention described in claim 12, there is provided the connector claimed in any one of claims 8 to 11, wherein the holder is made of metal.

For attaining the fourth object, according to the invention described in claim 13, there is provided the connector claimed in claim 8 or claim 9, wherein the holder is made by pressing a metal plate, and wherein the holder is integrally provided with a tube part formed in a tubular shape, and configured to receive the inner housing, a biasing part made by partially cutting the tube part and bending inward of the tube part, and configured to bias the inner housing toward an inner side wall of the receiving part, a second biasing part made by extending from one end of the tube part and bending toward the mating connector at an inside of the tube, interposed between the fixing part and the inner housing, and configured to bias the inner housing toward the mating connector, and a stopper made by extending from the other end of the tube part, and bending so as to cover an end wall of the inner housing at the mating connector side after the inner housing is inserted into the tube part via an opening at the other end side of the tube part, and configured to prevent the inner housing from falling out of the receiving part.

For attaining the first object, according to the invention described in claim 14, there is provided the connector claimed in any one of claims 8 to 13, wherein the inner housing is provided with an inner housing main body configured to receive the first electric connecting part, and an elastic arm continued to an outer wall of the inner housing main body and configured to elastically abut on an inner wall of the holder.

For attaining the second object, according to the invention described in claim 15, there is provided the connector claimed in any one of claims 1 to 14, wherein the inner housing is received in the receiving part movably in the all directions.

Advantageous Effects of Invention

According to the invention claimed in claim 1, the terminal is provided with the first electric connecting part received and held in the inner housing, and electrically connected to a mating connector, the second electric connecting part disposed further away from the mating connector than the first electric connecting part, and the coupling part made of conductive material, having flexibility or elasticity, and movably coupling and electrically connecting the first electric connecting part and the second connecting part, and the outer housing is provided with the receiving part movably receiving the inner housing receiving the first electric connecting part, and the fixing part to which the second electric connecting part is fixed. Therefore, when a position gap between the terminal and the terminal of the mating connector is generated, the inner housing supporting the first electric connecting part is moved in the receiving part so as to electrically connect the first electric connecting part and the terminal of the mating connector, thereby absorbs the position gap. Further, even when the inner housing and the first electric connecting part are moved in this way, the second electric connecting part is fixed to the fixing part, and not moved. Therefore, the connection reliability between the second electric connecting part and a member electrically connected to the second electric connecting part is prevented from being reduced. Further, when the first electric connecting part is moved in this way, the flexible or elastic coupling part is deformed. Therefore, a distortion between the first and second electric connecting parts is prevented from being generated. Further, when a vibration is applied to this connector, the coupling part is deformed to absorb the vibration. Therefore, the connection reliability between the terminal and the terminal of the mating connector is prevented from being reduced. Therefore, a connector able to be surely fitted with the mating connector by absorbing a position gap generated between the terminal and a terminal of the mating connector when fitting with the mating connector can be provided.

According to the invention claimed in claim 2, because the coupling part is composed of a braided wire, the coupling part can be deformed in all directions. Therefore, a connector able to be further surely fitted with the mating connector by absorbing a position gap generated between the terminal and a terminal of the mating connector in all directions when fitting with the mating connector can be provided.

According to the invention claimed in claim 3, the coupling part is made by pressing a metal plate, formed elastically deformable in all directions, and composed of a first circular part attached to the first electric connecting part, a second circular part attached to the second electric connecting part, and a plurality of bow-shaped parts of which one end is continued to the first circular part, and the other end is continued to the second circular part and formed in a band shape, and of which intermediate part between the first and second circular parts is bend in a bow shape. Further, because the coupling part is elastically deformed, the coupling part couples the first and second electric connecting parts movably in all directions. Therefore, a connector able to be further surely fitted with the mating connector by absorbing a position gap generated between the terminal and a terminal of the mating connector in all directions when fitting with the mating connector can be provided.

According to the invention claimed in claim 4, because the coupling part is composed of a coil spring, the coupling part can be deformed in all directions. Therefore, a connector able to be further surely fitted with the mating connector by absorbing a position gap generated between the terminal and a terminal of the mating connector in all directions when fitting with the mating connector can be provided.

According to the invention claimed in claim 5, the connector further includes a biasing member interposed between the fixing part and the inner housing, and configured to bias the inner housing toward the mating connector. Therefore, when the mating connector collides with the inner housing while fitting with the connector, the inner housing is once moved toward the fixing part, and then pushed back toward the mating connector due to the elastic restoring force of the biasing member. Therefore, the inner housing is prevented from clashing with the fixing part and from being damaged. Further, when a vibration is applied to this connector, the biasing member is elastically deformed to absorb the vibration. Therefore, the connection reliability between the terminal and the terminal of the mating connector is prevented from being reduced. Therefore, a connector able to be surely fitted with the mating connector by absorbing a position gap generated between the terminal and the terminal of the mating connector when fitting with the mating connector, and able to prevent the connector from being damaged by an impact generated when fitting with the mating connector can be provided.

According to the invention claimed in claim 6, because the biasing member is composed of a coil spring, a connector able to be surely fitted with the mating connector by absorbing a position gap generated between the terminal and the terminal of the mating connector when fitting with the mating connector, and able to prevent the connector from being damaged by an impact generated when fitting with the mating connector can be provided.

According to the invention claimed in claim 7, because the biasing member is made of rubber, and formed in a tubular shape, and the coupling member is positioned at an inside of the biasing member, a connector able to be surely fitted with the mating connector by absorbing a position gap generated between the terminal and the terminal of the mating connector when fitting with the mating connector, and able to prevent the connector from being damaged by an impact generated when fitting with the mating connector can be provided.

According to the invention claimed in claim 8, because the connector further includes: a tubular holder attached to an inside of the receiving part and configured to receive the inner housing, the strength of the receiving part can be improved. Therefore, a connector able to be surely fitted with the mating connector by absorbing a position gap generated between the terminal and the terminal of the mating connector when fitting with the mating connector, and able to prevent the connector from being damaged by an impact generated when fitting with the mating connector can be provided.

According to the invention claimed in claim 9, because the holder is attached to the inside of the receiving part movably in a direction perpendicular to a fitting direction with the mating connector, by a movement of the holder, the inner housing supporting the first electric connecting part is moved in the receiving part to absorb the position gap. Therefore, a connector able to be surely fitted with the mating connector by absorbing a position gap generated between the terminal and the terminal of the mating connector when fitting with the mating connector, and able to prevent the connector from being damaged by an impact generated when fitting with the mating connector can be provided.

According to the invention claimed in claim 10, because a biasing part configured to bias the inner housing toward an inner side wall of the receiving part is provided on the holder, by the elastic deformation of the biasing part, the inner housing supporting the first electric connecting part is moved in the receiving part to absorb the position gap. Therefore, a connector able to be surely fitted with the mating connector by absorbing a position gap generated between the terminal and the terminal of the mating connector when fitting with the mating connector, and able to prevent the connector from being damaged by an impact generated when fitting with the mating connector can be provided.

According to the invention claimed in claim 11, because a stopper configured to prevent the inner housing from falling out of the receiving part is provided on the holder, a connector able to be surely fitted with the mating connector by absorbing a position gap generated between the terminal and the terminal of the mating connector when fitting with the mating connector, able to prevent the connector from being damaged by an impact generated when fitting with the mating connector, and able to prevent the inner housing from falling out of the receiving part can be provided.

According to the invention claimed in claim 12, because the holder is made of metal, the strength of the holder can be improved, thereby, the strength of the receiving part can be further improved. Therefore, a connector able to be surely fitted with the mating connector by absorbing a position gap generated between the terminal and the terminal of the mating connector when fitting with the mating connector, and able to prevent the connector from being damaged by an impact generated when fitting with the mating connector can be provided.

According to the invention claimed in claim 13, because the holder is integrally provided with a tube part, a biasing part, a second biasing part, and a stopper, the holder is able to improve the strength of the receiving part, to absorb the position gap between the terminal and the terminal of the mating connector, to absorb the impact load applied to the inner housing when fitting with the mating holder, to prevent the inner housing from falling out of the receiving part, and to absorb the vibration applied to this connector. Therefore, a connector having a small number of components and a simple structure able to be surely fitted with the mating connector by absorbing a position gap generated between the terminal and the terminal of the mating connector when fitting with the mating connector, and able to prevent the connector from being damaged by an impact generated when fitting with the mating connector can be provided.

According to the invention claimed in claim 14, because the inner housing is provided with an inner housing main body configured to receive the first electric connecting part, and an elastic arm continued to an outer wall of the inner housing main body and configured to elastically abut on an inner wall of the holder, by the elastic deformation of the elastic arm, the inner housing supporting the first electric connecting part is moved in the receiving part to absorb the position gap. Therefore, a connector able to be surely fitted with the mating connector by absorbing a position gap generated between the terminal and a terminal of the mating connector when fitting with the mating connector can be provided.

According to the invention claimed in claim 15, because the inner housing is received in the receiving part movably in the all directions, a connector able to be further surely fitted with the mating connector by absorbing a position gap generated between the terminal and a terminal of the mating connector in all directions when fitting with the mating connector can be provided.

DESCRIPTION OF EMBODIMENTS (First Embodiment)

A connector according to a first embodiment of the present invention will be explained with reference to FIGS. 1 to 3.

Figure 1:
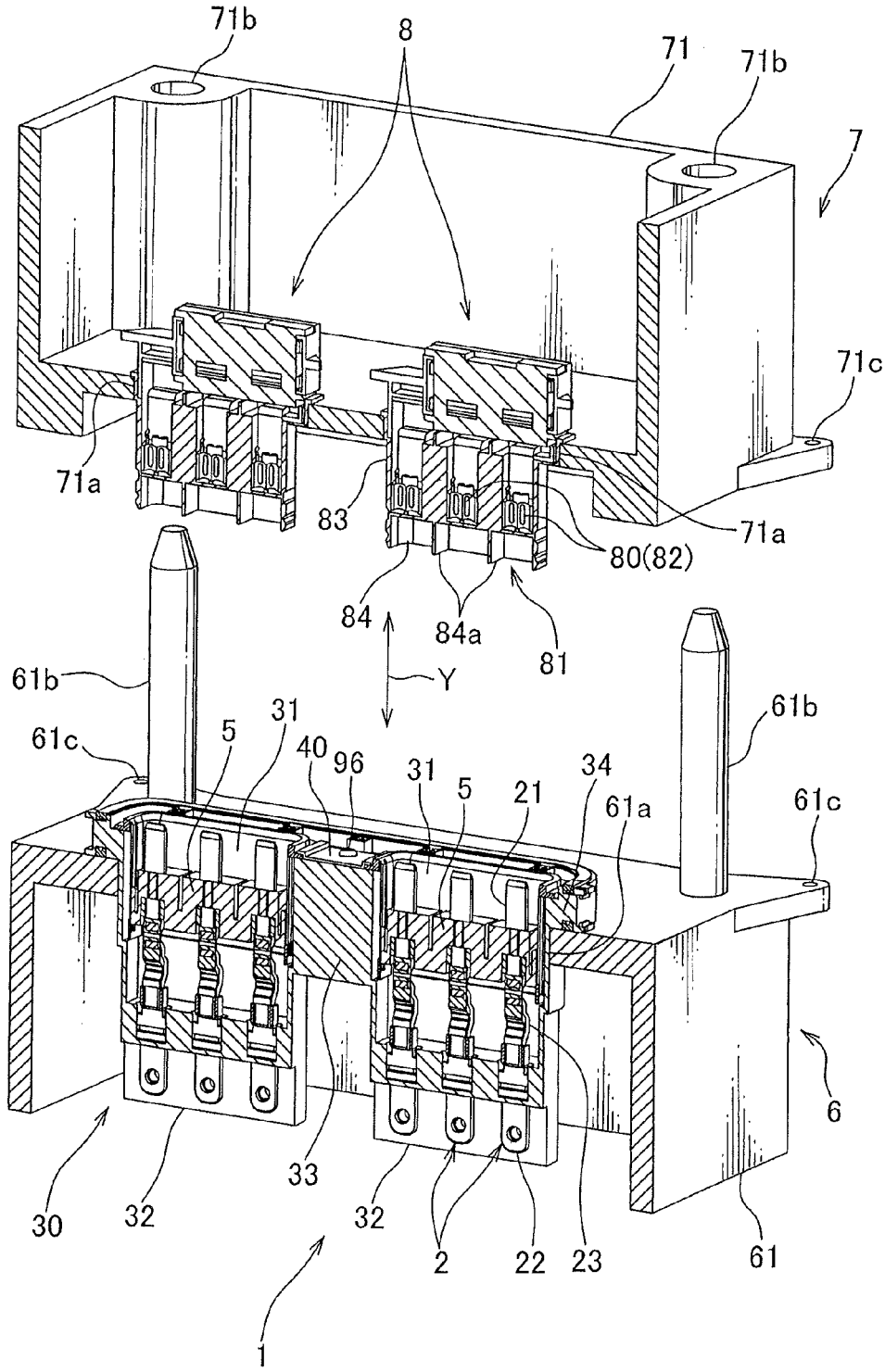
[FIG. 1] A sectional perspective view showing a connector according to a first embodiment of the present invention.

As shown in FIG. 1, a pair of connectors 1 is attached to a case 61 of a motor 6 mounted on an electric vehicle or a hybrid vehicle, and fitted with, namely, electrically connected to a pair of mating connectors 8 attached to a case 71 of an ECU (Electric Control Unit) 7. Namely, when the ECU 7 is mounted on the motor 6, the pair of connectors 1 is directly connected to the pair of mating connectors 8 integrally provided with the ECU 7.

Further, the pair of mating connectors 8 is respectively attached to a pair of connector receiving holes 71*a* provided on the case 71 of the ECU 7. The connector receiving hole 71*a* penetrates an outer wall of the case 71, and is formed in a shape following an outer surface of a housing main body 83 of a later-described housing 81 of the mating connector 8. Further, a positioning hole 71*b* into which a boss 61*b* of the motor 6 is inserted, and a bolt hole 71*c* overlapped with a bolt hole 61*c* of the motor 6 are provided around the connector receiving hole 71*a* of the case 71.

The mating connector 8 includes: a plurality of terminals 80; and a housing 81 made of synthetic resin. The terminal 80 is provided with a male electric contact part 82 into which a terminal 2 of the connector 1 is inserted and electrically connected to the terminal 2, and a circuit connecting part (not shown) continued to the electric contact part 82 and electrically connected to an electric circuit of the ECU 7. The housing 81 is provided with the box-shaped housing main body receiving a plurality of terminals 80, and a tubular hood part 84 extending from an end wall of the housing main body 83 facing the connector 1 toward the connector 1. When the mating connector 8 and the connector 1 are fitted with each other, a later-described inner housing 5 of the connector 1 is positioned at an inside of the hood part 84.

The mating connector 8 and the connector 1 are fitted with each other along a longitudinal direction of the electric contact part 82 received in the housing main body 83. Further, an arrow Y of FIG. 1 indicates a fitting direction of the mating connector 8 and the connector 1.

As shown in FIG. 1, the connector 1 is attached to a connector receiving hole 61*a* provided on a case 61 of the motor 6. The connector receiving hole 61*a* penetrates an outer wall of the case 61, and is formed in a shape following an outer surface of a later-described outer housing main body 32 of the connector 1. Further, a boss 61*b* for positioning the ECU 7, a bolt hole 61*c* for fixing the ECU 7, and a bolt hole 61*d* (see FIG. 3) in which a nut 91 is embedded for fixing the connector 1 are provided around the connector receiving hole 61*a* of the case 61.

As shown in FIG. 1, the connector 1 includes: a plurality of terminals 2; an inner housing 5 for receiving and holding a later-described first electric connecting part 21 of each terminal 2; an outer housing 30 for receiving a plurality of terminals 2 and inner housings 4; a holder 31 attached to the outer housing 30; and a fixing member 40 for fixing the holder 31 to the outer housing 30.

As shown in FIG. 1, the terminal 2 is provided with the first electric connecting part 21 received and held in the inner housing 5, disposed near the mating connector 8 in the outer housing 30, and electrically connected to an electric contact part 82 of a terminal 80 of the mating connector 8, a second electric connecting part 22 disposed further away from the mating connector than the first electric connecting part 21 in the outer housing 30, and electrically connected to an electric circuit of the motor 6, and a coupling part 23 movably coupling and electrically connecting the first electric connecting part 21 and the second connecting part 22.

The first electric connecting part 21 is made by pressing a metal plate, and formed separately from the second electric connecting part 22. The first electric connecting part 21 is provided with a rectangular-plate-shaped flat plate part 21*a* and a pair of crimping pieces 21*b*. One end of the flat plate part 21*a* disposed away from the second electric connecting part 22 is positioned at an outside of the inner housing 5, and inserted into the electric contact part 82 of the terminal 80 of the mating connector 8 to be electrically connected to the electric contact part 82. Further, a locking hole 21*c* (see FIG. 3) for locking a later-described locking arm 52 of the inner housing is provided on a center part of the flat plate part 21*a* positioned at an inside of the inner housing 5. The pair of crimping pieces 21*b* is provided on the other end of the flat plate part 21*a* disposed at the second electric connecting part 22, and respectively extended vertically from both ends in a width direction of the flat plate part 21*a*. By bending a tip end of each crimping piece 21*b* toward the flat plate part 21*a*, each crimping piece 21*b* clips the coupling part 23 with the flat plate part 21*a* to be electrically and mechanically connected to the coupling part 23.

The second electric connecting part 22 is made by pressing a metal plate. The second electric connecting part 22 is provided with a rectangular-plate-shaped flat plate part 22*a* and a pair of crimping pieces 22*b*. A one end of the flat plate part 22*a* disposed away from the first electric connecting part 21 is exposed to an outside of the outer housing 30. Further, a bolt hole 22*c* is provided on the one end of the flat plate part 22*a*. A terminal composing the electric circuit of the motor 6 is overlapped with the one end of the flat plate part 22*a*. By inserting a bolt into the bolt hole provided on the terminal and the bolt hole 22*c*, the one end of the flat plate part 22*a* is electrically and mechanically connected to the terminal of the motor 6. Further, a center part in a longitudinal direction of the flat plate part 22*a* is received in a later-described terminal receiving chamber 35*a* of the outer housing 30. A packing 92 for keeping a space between an inner wall of the terminal receiving chamber 35*a* and the second electric connecting part 22 watertight when the packing 92 closely contacts the inner wall of the terminal receiving chamber 35*a* is attached to the center part of the flat plate part 22*a*. The pair of crimping pieces 22*b* is provided on the other end of the flat plate part 22*a* disposed at the first electric connecting part 21, and respectively extended vertically from both ends in a width direction of the flat plate part 22*a*. By bending a tip end of each crimping piece 22*b* toward the flat plate part 22*a*, each crimping piece 22*b* clips the coupling part 23 with the flat plate part 22*a* to be electrically and mechanically connected to the coupling part 23.

The coupling part 23 is composed of a braided wire 23*a* and a cover 23*b* covering the braided wire 23*a*. The braided wire 23*a* is made by braiding a plurality of metallic element wires in a band shape, and is flexible. Further, the cover 23*b* is formed in a thin shape in order to be bent easily. Such a coupling part 23 is so formed as to be more flexible than the first electric connecting part 21 and the second electric connecting part 22. Further, the coupling part 23 is so formed as to be longer than a distance between the first electric connecting part 21 and the second electric connecting part 22 received in the outer housing 30. Namely, the coupling part 23 is received in the outer housing 30 while being bent. Further, at both ends of the coupling part 23, the cover 23*b* is stripped and the braided wire 23*a* is exposed. By crimping both ends of the exposed braided wire 23*a* with the crimping pieces 21*b* and 22*b*, the coupling part 23 is electrically and mechanically connected to the first electric connecting part 21 and the second electric connecting part 22.

Further, according to the present invention, because the coupling part 23 is composed of the braided wire 23*a*, the coupling part 23 can be more flexible than a round electric wire including: a core wire made by twisting a plurality of element wires; and a cover covering the core wire. Further, according to the present invention, because the coupling part 23 is composed of the braided wire 23*a*, the coupling part 23 can be deformed in all directions.

The outer housing 30 is made of insulating synthetic resin. The outer housing 30 integrally includes: a pair of outer housing main bodies 32; a coupling body 33 coupling the pair of outer housing bodies 32; and a flange 34. Further, the pair of outer housing main bodies 32 is in the same structure.

Figure 2:
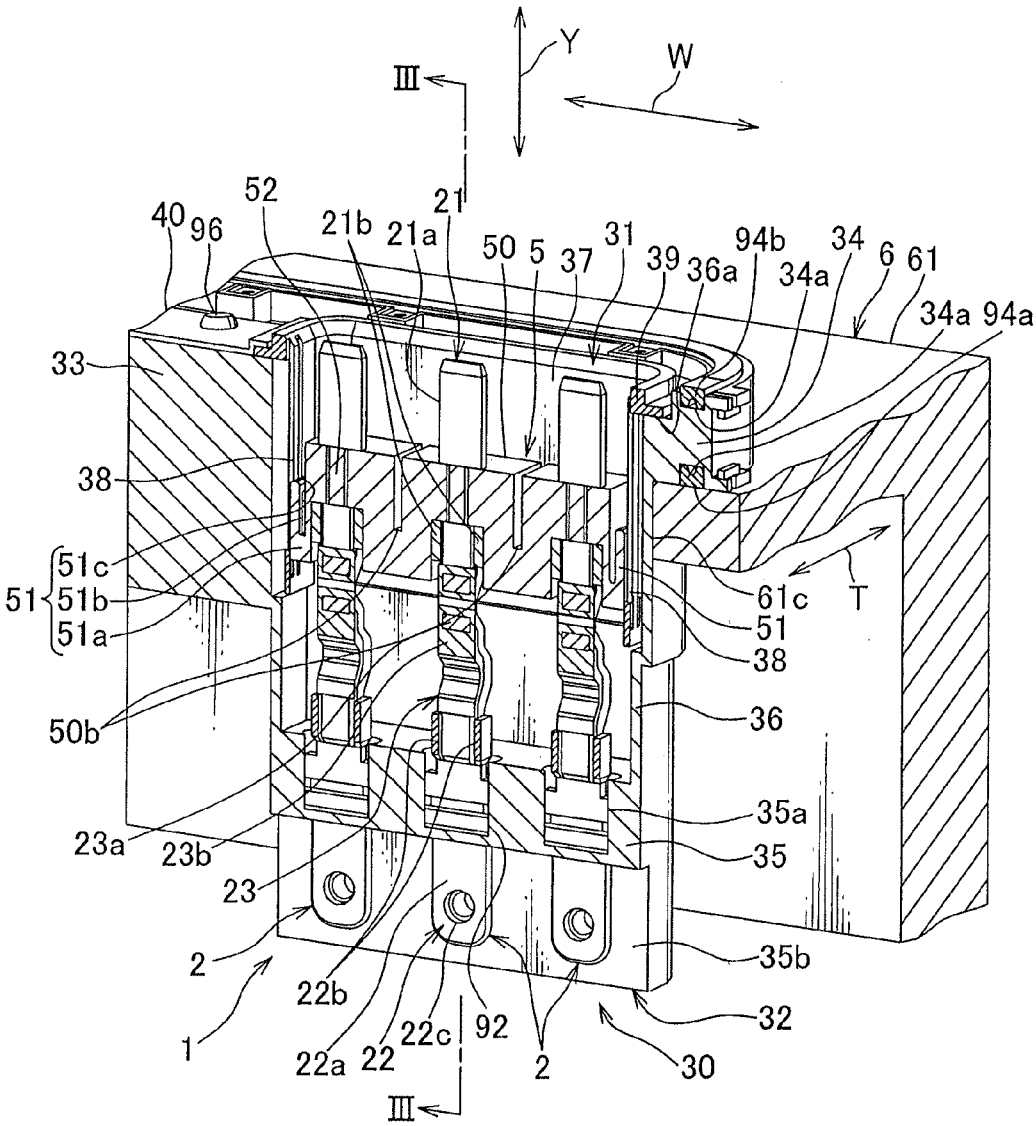
[FIG. 2] A sectional perspective view showing by enlarging a main part of the connector shown in FIG. 1.

As shown in FIG. 2, the outer housing main body 32 is integrally provided with a receiving part 36 in which the inner housing 5 receiving the first electric connecting part 21 is received movably in all direction, a fixing part 35 to which the second electric connecting part 22 is fixed, and a terminal exposure part 35*b*.

The fixing part 35 is formed in a block shape. The fixing part 35 is provided with a plurality of terminal receiving chambers 35*a* penetrating the fixing part 35 along an arrow Y direction. Each of these terminal receiving chambers 35*a* receives the center part in a longitudinal direction of the flat plate part 22*a* of the second electric connecting part 22.

The terminal exposure part 35*b* is extended from an end wall of the fixing part 35 away from the receiving part 36. The one end of the flat plate part 22*a* disposed outside of the terminal receiving chamber 35*a* is positioned on a surface of the terminal exposure part 35*b*. Further, a nut 93 for screwing with a bolt which is inserted into the bolt hole 22*c* is embedded in the terminal exposure part 35*b*. Further, a reference sign 35*c* in FIG. 3 indicates a bolt hole into which a bolt is inserted.

The receiving part 36 is extended in a tubular shape from an end wall of the fixing part 35 away from the terminal exposure part 35*b*. This receiving part 36 receives the other end of the flat plate part 22*a* of the second electric connecting part 22, the coupling part 23, the first electric connecting part 21, and the inner housing 5 which receives and holds the first electric connecting part 21.

As shown in FIG. 1, one end of the coupling body 33 is continued to an outer peripheral wall of the one outer housing main body 32 near the mating connector 8, and the other end of the coupling body 33 is continued to an outer peripheral wall of the other outer housing main body 32 near the mating connector 8. The coupling body 33 couples the pair of outer housing main bodies 32 with each other in a manner that center axes of the pair of outer housing main bodies 32 are parallel to each other.

The flange 34 is provided on ends of the coupling body 33 and the pair of outer housing main bodies 32 near the mating connector 8, projected in a flange shape from the outer peripheral wall of the coupling body 33 and the pair of outer housing main bodies 32, and formed in a ring shape as a whole. This flange 34 is overlapped with an outer surface of the case 61 while the coupling body 33 and the pair of flange 34 are inserted into the connector receiving hole 61*a*.

Further, attaching grooves 34*a* are respectively provided on a lower wall on which the flange 34 is overlapped with the case 61, and an upper wall opposite to the lower wall on which the flange 34 is overlapped with the case 71 of the ECU 7. Each attaching groove 34*a* is formed in a ring shape extending around the whole circumference of the flange 34. Further, a ring shaped packing 94*a* is attached to the attaching groove 34*a* provided on the lower wall of the flange 34. This packing 94*a* is closely attached to an outer surface of the case 61 to keep a space between the case 61 and the outer housing 30 watertight. Further, a ring shaped packing 94*b* is attached to the attaching groove 34*a* provided on the upper wall of the flange 34. This packing 94*b* is closely attached to an outer surface of the case 71 of the ECU 7 to keep a space between the case 71 and the outer housing 30 watertight.

Further, a concave 36*a* on which a later-described flange 39 of the holder 31 is positioned is provided on the upper wall of the flange 34, and a surface of the coupling body 33 facing the mating connector 8.

Figure 3:
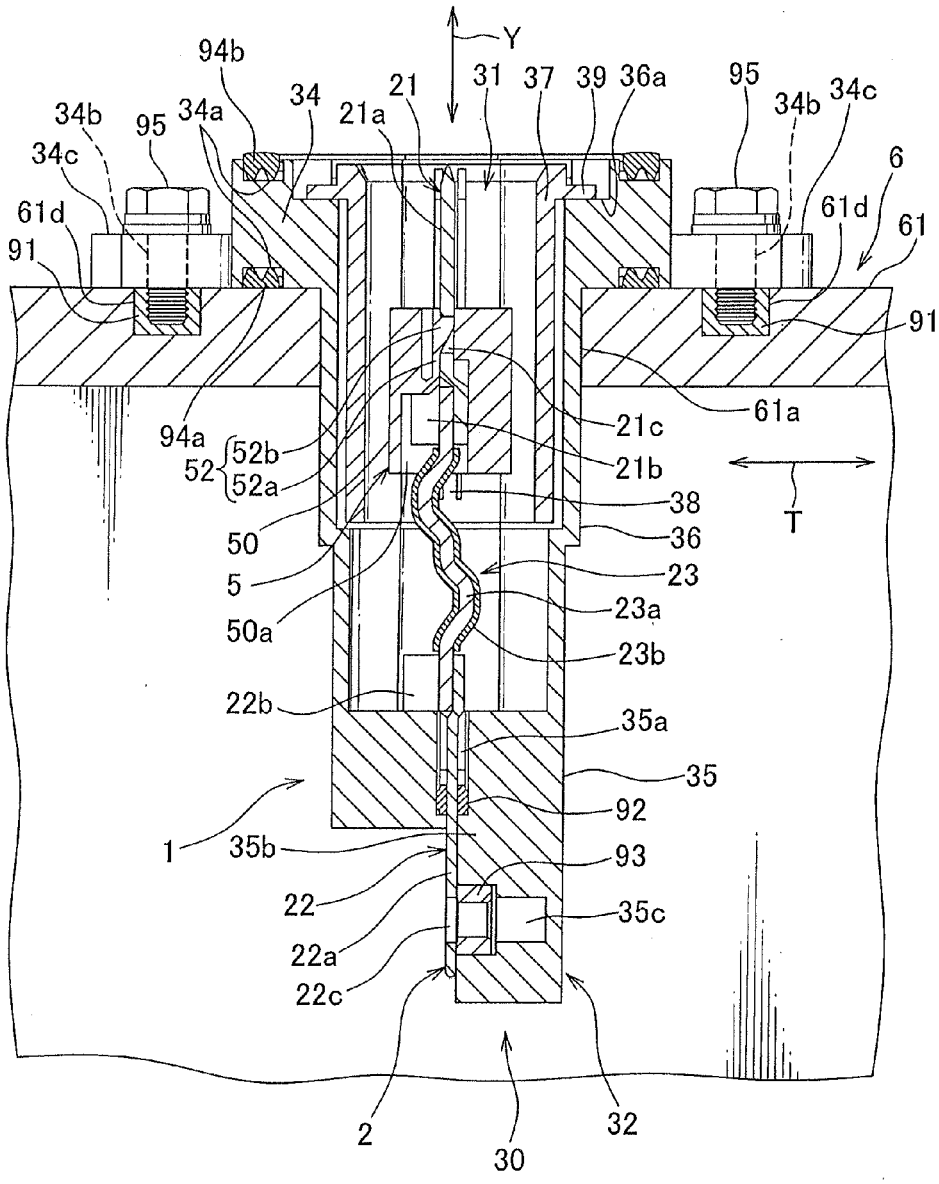
[FIG. 3] A sectional view taken on line of FIG. 2.

Further, as shown in FIG. 3, a plurality of bolt holding pieces 34*c* each on which a bolt hole 34*b* is formed is provided on an outer periphery of the flange 34. This bolt holding piece 34*c* is overlapped with an outer surface of the case 61, and the bolt hole 34*b* is overlapped with the bolt hole 61*d* formed on the case 61, while the coupling body 33 and the pair of outer housing main bodies 32 are inserted into the connector receiving hole 61*a*. Then, when a bolt 95 is screwed into the bolt holes 34*b*, 61*d*, the outer housing 30, namely, the connector 1 is attached to the case 61.

The holder 31 is made of insulating synthetic resin. As shown in FIG. 1, two holders 31 are provided, and respectively attached to the receiving parts 36 of the outer housings 30 one by one. As shown in FIGS. 2 and 3, each holder 31 is provided with a tube 37, the flange 39, and a pair of elastically contact parts 38.

An outer diameter of the tube 37 is smaller than an inner diameter of the receiving part 36. The tube 37 is attached to an inside of the receiving part 36 with a gap between the tube 37 and an inner side wall of the receiving part 36. Further, the inner housing 5 to which the first electric connecting part 21 is attached is received movably in all directions in an inside of the tube 37 attached to the receiving part 36. Further, the housing 81 of the mating connector 8 is inserted into the tube 37 attached to the receiving part 36.

The flange 39 is projected in a flange shape from an outer periphery of the tube, and formed in a ring shape along a whole circumference of the tube 37. This flange 39 is positioned on the above-described concave 36*a*, while the tube 37 is positioned on the inside of the receiving part 36.

The pair of elastically contact parts 38 is provided at positions facing each other of the tube 37. This elastically contact part 38 is formed in a plate shape extending along the arrow Y direction, and both ends of the elastically contact part 38 are continued to the tube 37, thereby supported at both sides. Namely, the elastically contact part 38 is a portion disposed between a pair of parallel slits when the pair of slits is provided on the tube 37. This elastically contact part 38 elastically contacts a later-described elastic arm 51 of the inner housing 5. Further, when the elastically contact part 38 contacts the elastic arm 51 of the inner housing 5, the elastically contact part 38 is bent toward an outside of the tube 37.

The fixing member 40 is made by pressing a metal plate. The fixing member 40 is formed in a substantially rectangular plate shape, and a bolt hole is provided on the center of the fixing member 40. While the fixing member 40 is overlapped with a surface of the coupling body 33 facing the mating connector 8, and both ends of the fixing member 40 are overlapped with the flanges 39 of the holders 31, the fixing member 40 is fixed to the outer housing 30 with a bolt 96 through the bolt hole. The fixing member 40 fixes the holder 31 to the outer housing 30 by clipping the flange 39 between the fixing member 40 and the outer housing 30.

The inner housing 5 is made of insulating synthetic resin. As shown in FIG. 1, two inner housings 5 are provided, and respectively received in the two holders 31 one by one. As shown in FIG. 2, an inner housing main body 50, the pair of elastic arms 51, and a locking arm 52 are integrally formed on the inner housing 5.

The inner housing main body 50 is formed in a box shape. A plurality of terminal receiving chambers 50*a* for respectively receiving the first electric connecting part 21 of the terminal 2 is provided in the inner housing main body 50. Each of these terminal receiving chambers 50*a* receives the other end in a longitudinal direction and the center part of the flat plate part 21*a* of the first electric connecting part 21, and the crimping piece 21*b*. A slit 50*b* into which a partition wall 84*a* of the mating connector 8 proceeds is provided on a surface of the inner housing main body 50 facing the mating connector 8.

As shown in FIG. 2, the pair of elastic arms 51 is continued to outer side walls disposed at both ends of the inner housing main body 50 in a width direction (indicated by an arrow W in FIG. 2) and extended in a cantilever shape. A base 51*a* projected from the outer side wall of the inner housing main body 50, and an arm main body 51*b* extended from the base 51*a* toward the mating connector 8 and extended in a bar shape toward a side away from the outer side wall of the inner housing main body 50 are formed on the elastic arm 51. A free end 51*c* of the elastic arm 51 is formed elastically deformable along a direction approaching and separating from the outer side wall of the inner housing main body 50, namely, the width direction (indicated by the arrow W in FIG. 2) of the inner housing main body 50. When the free end 51*c* of the elastic arm 51 elastically contacts the elastically contact part 38, the inner housing 5 is movably received in the holder 31, namely, the receiving part 36.

As shown in FIG. 3, the locking arm 52 is provided in the terminal receiving chamber 50*a* of the inner housing main body 50. The locking arm 52 is provided with an arm main body 52*a* extended in a cantilever shape from an inner wall of the terminal receiving chamber 50*a*, and a locking projection 52*b* formed on a free end of the arm main body 52*a* for locking with the locking hole 21*c*. Further, the free end of the arm main body 52*a* is provided elastically deformable in a thickness direction of the inner housing main body 50 (indicated by an arrow T in FIGS. 2 and 3), namely, a direction crossing an elastically deforming direction of the elastic arm 51. When the arm main body 52*a* is elastically deformed in the thickness direction of the inner housing main body 50 (indicated by an arrow T in FIGS. 2 and 3), this locking arm 52 movably attaches the first electric connecting part 21 to the inner housing main body 50.

Further, when the elastic arm 51 and the elastically contact part 38 are elastically deformed along the width direction (indicated by the arrow W in FIG. 2) of the inner housing main body 50, the inner housing 5 attached to the inside of the receiving part 36 and having the first electric connecting part 21 movably supports the first electric connecting part 21 attached to the inner housing main body 50 in the receiving part 36 in the width direction of the inner housing main body 50. Further, when the arm main body 52*a* of the locking arm 52 is elastically deformed along the thickness direction (indicated by the arrow T in FIGS. 2 and 3) of the inner housing main body 50, the inner housing 5 movably supports the first electric connecting part 21 in the receiving part 36 in the thickness direction (indicated by the arrow T in FIGS. 2 and 3) of the inner housing main body 50. Thus, according to the present invention, a moving direction of the first electric connecting part 21 when the elastic arm 51 is elastically deformed is a direction crossing a moving direction of the first electric connecting part 21 when the locking arm 52 is elastically deformed. Accordingly, the flexibility of the moving direction of the first electric connecting part 21 is improved, and the first electric connecting part 21 further easily copes with the position gap.

Next, an assembling method of the connector 1 will be explained. First, the tubes 37 of holders 31 are respectively inserted into the receiving parts 36 of the outer housing 30. Then, after the flange 39 is positioned in the concave 36*a*, the fixing member 40 is fixed to the coupling body 33 of the outer housing 30 with a bolt to attach the holders 31 to the outer housing 30. Further, the packings are attached to the attaching grooves 34*a* of the outer housing 30. Further, the first electric connecting part 21 of the terminal 2 is inserted into the terminal receiving chambers 50*a* of the inner housing main body 50 and the locking arm 52 is locked with the locking hole 21*c*, thereby the first electric connecting part 21 is attached to the inner housing 5. Further, a packing 92 is attached to the second electric connecting part 22 of the terminal 2. Then, the inner housing 5 having the terminal 2 and the first electric connecting part 21 is inserted into the outer housing 30 via an opening of the receiving part 36, the second electric connecting part 22 is inserted into the terminal receiving chamber 35*a* of the fixing part 35, and the inner housing 5 having the first electric connecting part 21 is inserted into the receiving part 36, namely, the holder 31. Thus, the connector 1 is assembled.

The connector 1 assembled as above described is inserted into the connector receiving hole 61*a*, and the flange 34 of the outer housing 30 is overlapped with the outer surface of the case 61, and then, the bolt 95 is screwed into the bolt hole 34*b* of the bolt holding piece 34*c* and the bolt hole 61*d* of the case 61, thereby the connector 1 is attached to the case 61 of the motor 6. Then, a terminal as a component of the electric circuit of the motor 6 is overlapped with the second electric connecting part 22 positioned on a surface of the terminal exposure part 35*b*, and a bolt is screwed into a bolt hole formed on the terminal and the bolt holes 22*c*, 35*c*, thereby the electric circuit of the motor 6 and the second electric connecting part 22 are electrically connected to each other.

Next, a condition when the connector 1 and the mating connector 8 are fitted together will be explained. When the mating connector 8 of the ECU 7 is moved close to the connector 1 of the motor 6 along the arrow Y direction, the boss 61*b* provided on the case 61 is inserted into the positioning hole 71*b*. When the mating connector 8 is moved further close to the connector 1, the housing 81 of the mating connector 8 is inserted into the tube 37 of the holder 31, namely, into the receiving part 36, and the first electric connecting part 21 is inserted into the electric contact part 82 of the mating connector 8. Further, at this time, if a position gap is generated between the first electric connecting part 21 and the electric contact part 82, the inner housing main body 50 is moved within the holder 31, and the elastic arm 51, the elastically contact part 38, the locking arm 52, and the coupling part 23 are elastically deformed to absorb the position gap. Then, the first electric connecting part 21 is fully inserted into the electric contact part 82, and the first electric connecting part 21 and the electric contact part 82 are electrically connected to each other. Thus, the connector 1 and the mating connector 8 are fitted together, and the motor 6 and the ECU 7 are electrically connected to each other. Then, a bolt is inserted into the bolt hole 61*c* of the motor 6 and the bolt hole 71*c* of the case 71, and a nut is screwed onto the bolt, thereby the case 61 of the motor 6 and the case 71 of the ECU 7 are fixed to each other.

Thus, according to the connector 1 of the present invention, when the connector 1 and the mating connector 8 are fitted together, the inner housing main body 50 having the first electric connecting part 21 is moved within the holder 31, and the elastic arm 51, the elastically contact part 38, the locking arm 52, and the coupling part 23 are elastically deformed to absorb the position gap generated between the first electric connecting part 21 of the terminal 2 and the terminal 80 of the mating connector 8 in all directions, thereby the connector 1 and the mating connector 8 are surely fitted together. Further, because the elastically contact part 38 is elastically deformed on the inner wall of the receiving part 36, when the elastic arm 51 is deformed, a large load is not applied to the elastically deformed elastic arm 51. Therefore, the elastic arm 51 is prevented from being broken.

Further, according to the connector 1 of the present invention, because while the inner housing 5 and the first electric connecting part 21 are moved, the second electric connecting part 22 is fixed to the fixing part 35 and not moved, the connection reliability between the second electric connecting part 22 and the terminal as a component of the electric circuit of the motor 6 and electrically connected to the second electric connecting part 22 is prevented from being reduced. Further, as described above, when the first electric connecting part 21 is moved, because the coupling part 23 having the flexibility is elastically deformed, the first electric connecting part 21 and the second electric connecting part 22 are prevented from being distorted.

Further, when a vibration is applied to the connector 1, because the elastic arm 51, the elastically contact part 38, and the coupling part 23 are elastically deformed to absorb the vibration, the connection reliability between the terminal 2 and the terminal 80 of the mating connector 8 is prevented from being reduced.

Further, because the connector 1 of the present invention includes the holder 31 attached to the receiving part 36, the strength of the receiving part 36 is improved. Therefore, the outer housing 30 and the like can be prevented from being broken by an impact when fitting with the mating connector 8.

According to the above-described embodiment, the connector 1 is attached to the case 61 of the motor 6, however, the connector 1 of the present invention may be attached to a case of the other electronic device. Similarly, the mating connector 8 may be attached to a case of the electronic device other than the ECU 7.

Further, according to the above-described embodiment, the coupling part 23 is composed of the braided wire 23*a* and the cover 23*b*, although there is a fear that the flexibility is reduced, the coupling part 23 may be composed of a core wire formed by twisting a plurality of element wires, and a cover for covering the core wire. Further, the coupling part 23 may be composed of only the braided wire 23*a* without the cover 23*b*. Further, any shape and any material may be used as the coupling part 23 as long as the flexibility is greater than those of the first electric connecting part 21 and the second electric connecting part 22, and the material has the conductivity.

Further, according to the above-described embodiment, the locking arm 52 is locked with the first electric connecting part 21, however, the connector 1 of the present invention may not be provided with the locking arm 52, and the first electric connecting part 21 may be insert-molded in the inner housing main body 50. Further, although there is a fear that the moving flexibility of the first electric connecting part 21 may be reduced, an elastically deforming direction of the locking arm 52 may be parallel to an elastically deforming direction of the elastic arm 51.

(Second Embodiment)

A connector 101 according to a second embodiment of the present invention will be explained with reference to FIGS. 4 to 7.

Figure 5:
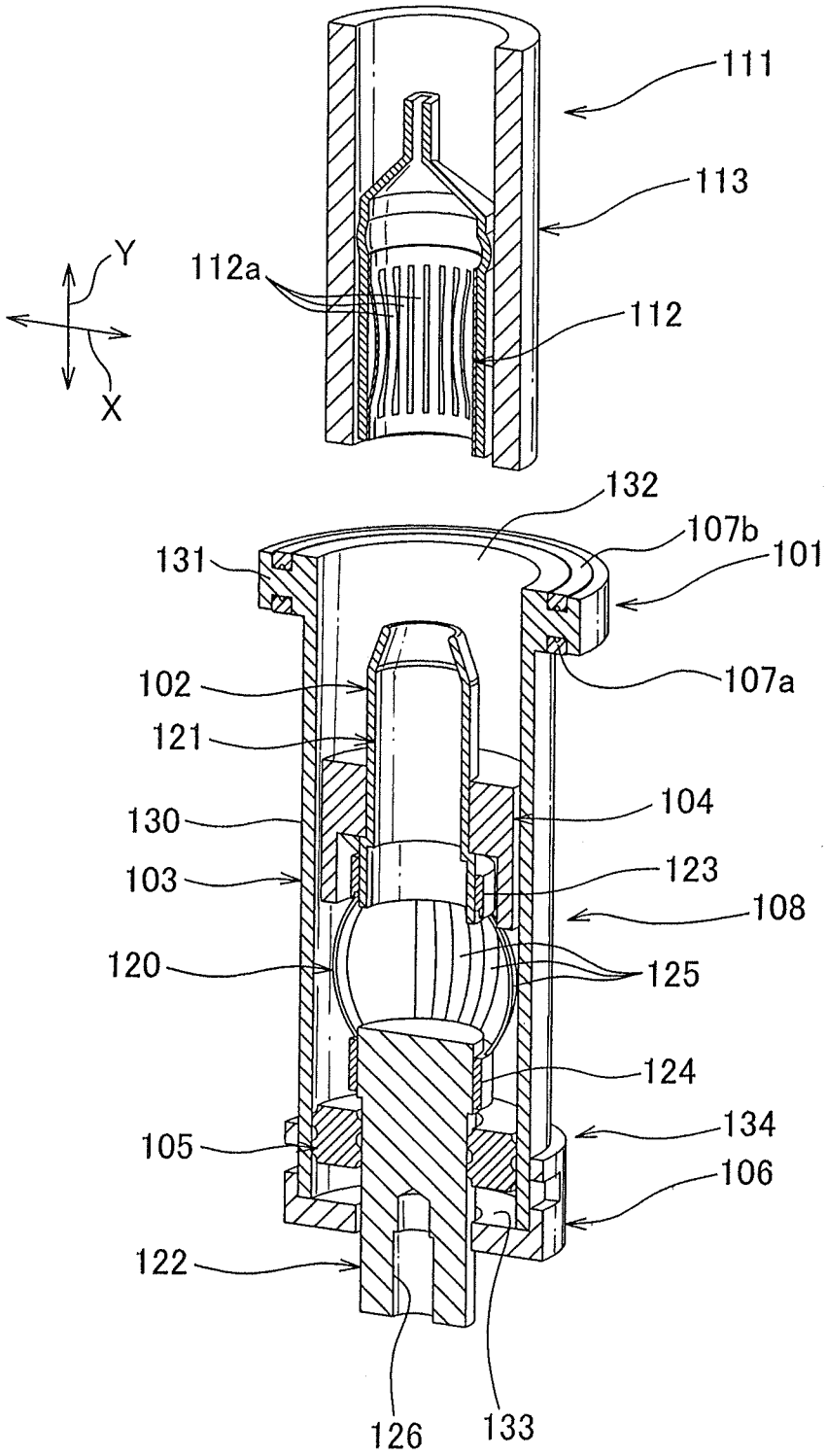
[FIG. 5] A sectional perspective view taken on line A-A of FIG. 4.

As shown in FIG. 5, the connector 101 is fitted with a mating connector 111 to be electrically connected to the mating connector 111. Further, the mating connector 111 includes: a tubular housing 113; and a terminal 112 received in the housing 113. The terminal 112 is made of a metallic plate, and formed in a tubular shape, namely, a female type. Further, a plurality of spring pieces 112*a* elastically deformable along a radial direction of the terminal 112 is provided on the terminal 112 by forming a plurality of slits on an outer wall of the terminal 112. These spring pieces 112*a* elastically contact a first electric connecting part 121 of a later-described terminal 102 of the connector 101, and press the first electric connecting part 121 inward.

Further, an arrow Y shown in FIGS. 4 to 7 indicates a fitting direction of the mating connector 111 and the connector 101, and an arrow X indicates a direction perpendicular to the fitting direction.

Figure 4:
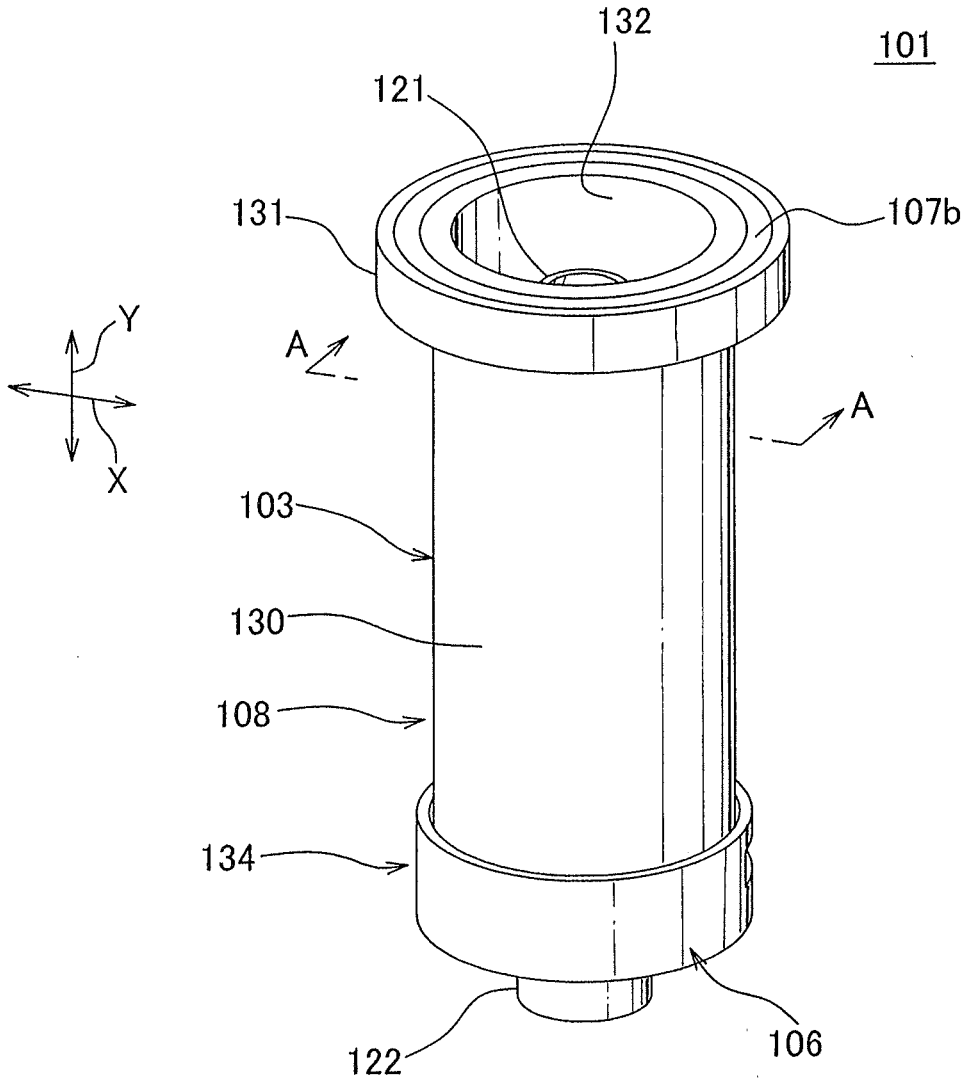
[FIG. 4] A perspective view showing a connector according to a second embodiment of the present invention.
Figure 6:
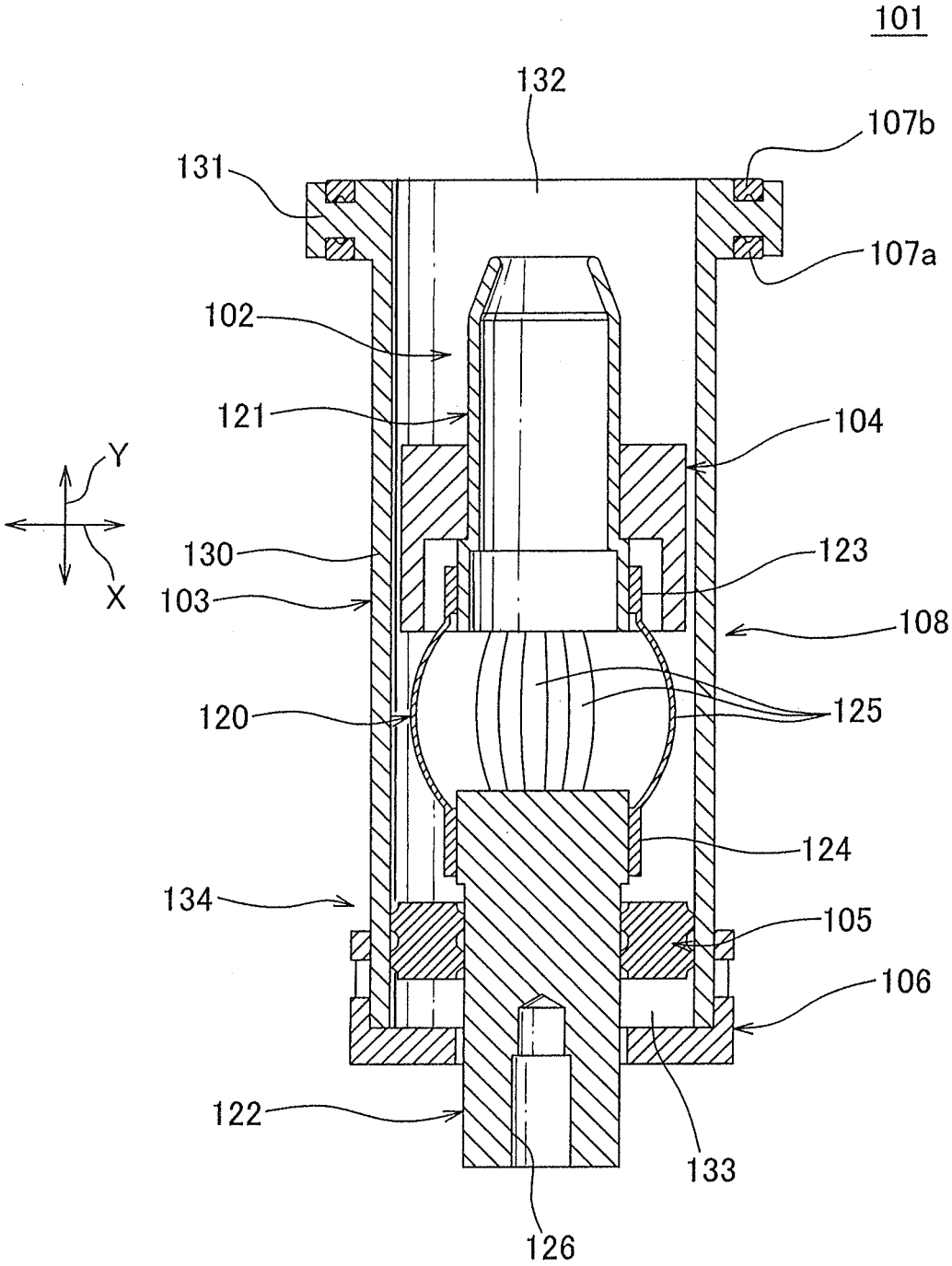
[FIG. 6] A sectional view taken on line A-A of FIG. 4.

As shown in FIGS. 4 to 6, the connector 101 includes: a terminal 102; an inner housing receiving the later-described first electric connecting part 121 of the terminal; and an outer housing 108 receiving the terminal 102 and the inner housing 104.

Figure 7:
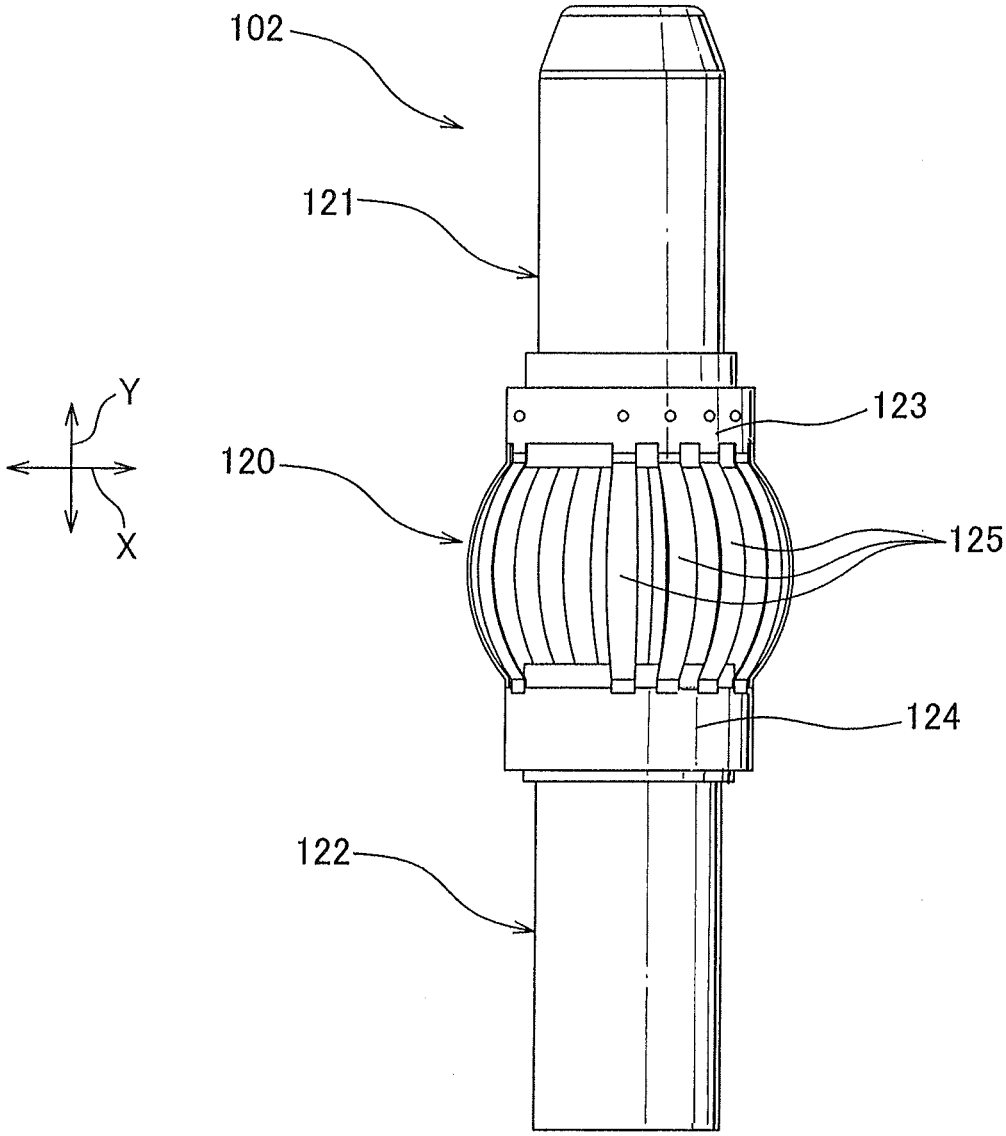
[FIG. 7] A plan view showing a terminal of the connector shown in FIG. 4.

As shown in FIG. 7, the terminal 102 is provided with the first electric connecting part 121 for electrically connected to the terminal 112 of the mating connector 111, a second electric connecting part 122 for electrically connected to a not-shown terminal (for example, a terminal as a component of an electric circuit of an electronic device), and a coupling part 120 for movably and electrically connecting the first electric connecting part 121 and the second electric connecting part 122.

The first electric connecting part 121 is made of conductive metal, and formed in a bar shape, namely, a male type. This first electric connecting part 121 is inserted into the terminal 112 of the mating connector 111. Further, by pressing the first electric connecting part 121 toward an inside of the terminal 112 with the spring pieces 112*a*, an electric connection between the first electric connecting part 121 and the terminal 112 is maintained. Further, the spring pieces 112*a* of the terminal 112 follow the movement of the first electric connecting part 121 in an arrow X direction.

The second electric connecting part 122 is made of conductive metal, and formed in a cylinder shape. Further, a receiving hole 126 formed in a concave shape from an end away from the first electric connecting part 121 is provided on the second electric connecting part 122. This second electric connecting part 122 is electrically connected to a not-shown terminal inserted into the receiving hole 126.

The coupling part 120 is made by pressing a metal plate. The coupling part 120 is integrally provided with a first circular part 123 attached to an end of the first electric connecting part 121 near the second electric connecting part 122, a second circular part 124 attached to an end of the second electric connecting part 122 near the first electric connecting part 121, and a plurality of arch-shaped parts 125 of which one end is continued to the first circular part 123, and the other end is continued to the second circular part 124, and having a band shape bent between the first circular part 123 and the second circular part 124.

Further, by twisting the first circular part 123 and the second circular part 124 around the ends of the first electric connecting part 121 and the second electric connecting part 122, and by welding them to the first electric connecting part 121 and the second electric connecting part 122, the first circular part 123 and the second circular part 124 are attached to outer peripheries of the first electric connecting part 121 and the second electric connecting part 122 in a circular shape. Further, the first circular part 123 and the second circular part 124 are electrically connected to the first electric connecting part 121 and the second electric connecting part 122.

Incidentally, in this embodiment, the first circular part 123 and the second circular part 124 are respectively welded to the first electric connecting part 121 and the second electric connecting part 122. However, according to the present invention, the first circular part 123 and the second circular part 124 may respectively press-fit the first electric connecting part 121 and the second electric connecting part 122.

Further, the arch-shaped parts 125 are bent in an arch shape in a manner projecting in a direction separating from each other, and as a whole, formed in a ball shape. Further, as shown in FIG. 7, the arch-shaped parts 125 are bent and plastically deformed. Namely, external force is not applied to the coupling part 120 shown in FIG. 7.

Because the arch-shaped parts 125 are respectively formed elastically deformable, the coupling part 120 is elastically deformable in all directions as a whole. Incidentally, "all directions" means an arranging direction of first electric connecting part 121 and the second electric connecting part 122, and a direction crossing the arranging direction. When the arch-shaped parts 125 are elastically deformed, the coupling part 120 movably couples the first electric connecting part 121 and the second electric connecting part 122 in all directions, namely, the arranging direction of the first electric connecting part 121 and the second electric connecting part 122, and the direction crossing the arranging direction.

The inner housing 104 is made of synthetic resin, and formed in a tubular shape. A center part of the first electric connecting part 121 in a longitudinal direction is attached to an inside of the inner housing 104.

The outer housing 108 is provided with an outer housing main body 103 on which a receiving part 130 movably in all directions receives the inner housing 104 receiving and holding the first electric connecting part 121, a fixing part 134 to which the second electric connecting part 122 is fixed, and packings 107*a*, 107*b* attached to a flange 131 formed on one end of the outer housing main body 103.

The outer housing main body 103 is made of synthetic resin. The outer housing main body 103 integrally includes: the tubular receiving part 130 extending in the arrow Y direction; and a flange 131 extending in a flange shape from one end of the receiving part 130 to an outside of the receiving part 130 in the arrow X direction.

Further, the first electric connecting part 121 of the terminal 102 is positioned at one end of the receiving part 130, and the second electric connecting part 122 of the terminal 102 is positioned at the other end of the receiving part 130, and received in the receiving part 130. Further, the inner housing 104 receiving and holding the first electric connecting part 121 is received in the receiving part 130 with a gap between the inner housing 104 and an inner side wall of the receiving part 130. The gap is for the first electric connecting part 121 to move in a direction crossing the arrow Y. Further, the mating connector 111 is inserted into the receiving part 130 from an opening 132 positioned at the one end of the receiving part 130.

The fixing part 134 is composed of a water shutoff valve 105 attached to an outer periphery of the second electric connecting part 122, and press-fitted into the receiving part 130, a cap 106 attached to the other end of the receiving part 130, and the other end of the receiving part 130.

The water shutoff valve 105 is made of elastically deformable synthetic resin such as synthetic rubber, and formed in a tubular shape. This water shutoff valve 105 is press-fitted into an inside at the other end of the receiving part 130, while the center part of the second electric connecting part 122 in the longitudinal direction is attached to an inside of the water shutoff valve 105. Further, the water shutoff valve 105 is closely attached to an outer surface of the second electric connecting part 122, and an inner side wall of the receiving part 130. When the water shutoff valve 105 is press-fitted into the receiving part 130, the second electric connecting part 122 is fixed to the other end of the receiving part 130.

The cap 106 is attached to the other end of the receiving part 130 away from the flange 131, and seals an opening 133 positioned at the other end to prevent the terminal 102 from falling out of the receiving part 130. Further, an insert hole for inserting an end of the second electric connecting part 122 away from the first electric connecting part 121 is formed at the center of the cap 106. Namely, the end of the second electric connecting part 122 away from the first electric connecting part 121 is positioned outside of the receiving part 130.

Further, because the first electric connecting part 121 and the second electric connecting part 122 are coupled by the coupling part 120 which is elastically deformable in all directions, while the second electric connecting part 122 is fixed to the fixing part 134, the first electric connecting part 121 of the terminal 102 is movable in above-described all directions.

According to the connector 101 having the above-described structure, when the connector 101 is fitted with the mating connector 111, the arch-shaped parts 125 of the coupling part 120 are elastically deformed as the first electric connecting part 121 is inserted into the terminal 112 of the mating connector 111, thereby the first electric connecting part 121 and the inner housing 104 are moved in the receiving part 130 to absorb the position gap generated between the terminal 112 of the mating connector 111 and the first electric connecting part 121 in all directions. Therefore, the connector 101 of the present invention is surely fitted with the mating connector 111.

Further, according to the connector 101 of the present invention, an impact load applied to the first electric connecting part 121 and the inner housing 104 by fitting the connector 101 and the mating connector 111 together can be absorbed by an elastic deformation of the arch-shaped parts 125 of the coupling part 120.

Further, according to the connector 101 of the present invention, because the second electric connecting part 122 is electrically connected to the first electric connecting part 121 via the coupling part 120, even when the first electric connecting part 121 is moved in any direction due to the fitting with the mating connector 111, the second electric connecting part 122 is not moved, thereby the connection reliability between the second electric connecting part 122 and a not-shown terminal electrically connected to the second electric connecting part 122 is prevented from being reduced.

Further, according to the connector 101 of the present invention, when the coupling part 120 absorbs the vibration applied to the outer housing 108, the vibration is hard to be transmitted to the terminal 102, thereby the connection reliability between the terminal 102 and the terminal 112 of the mating connector 111 is prevented from being reduced.

(Third Embodiment)

Figure 8:
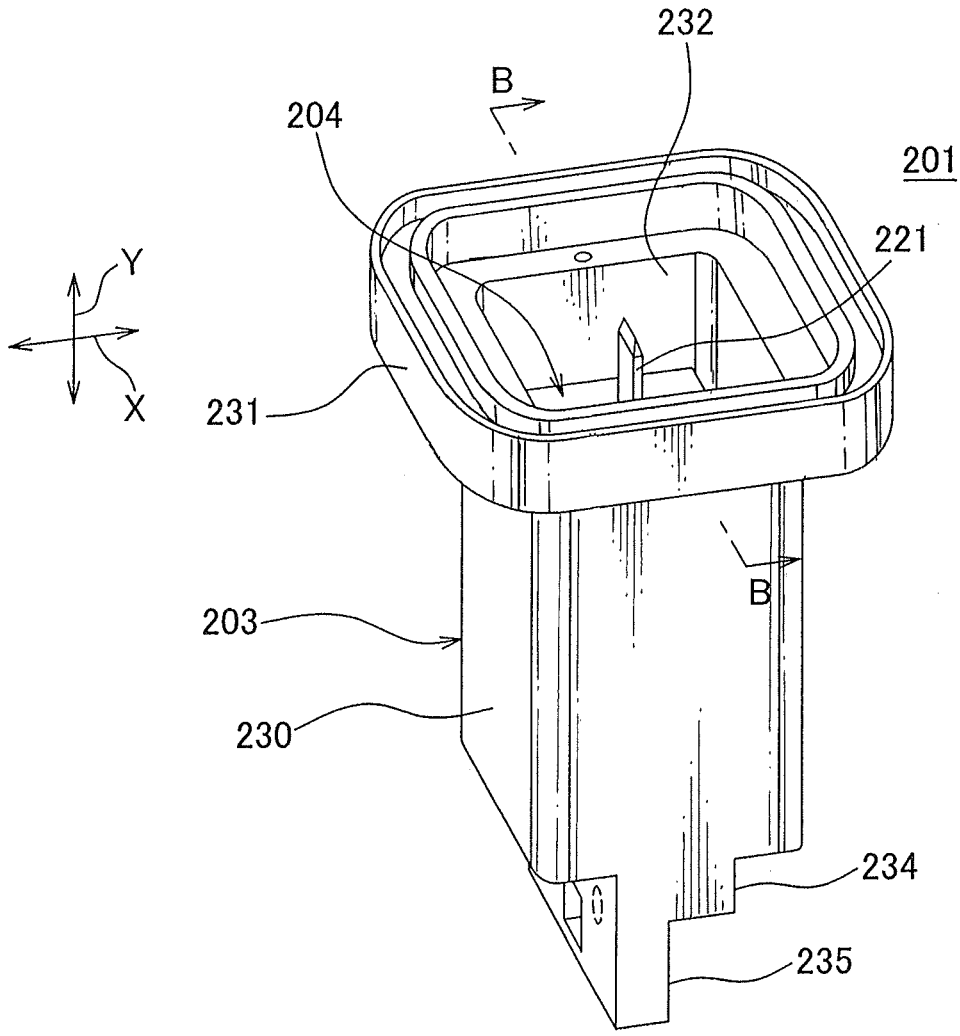
[FIG. 8] A perspective view showing a connector according to a third embodiment of the present invention.
Figure 9:
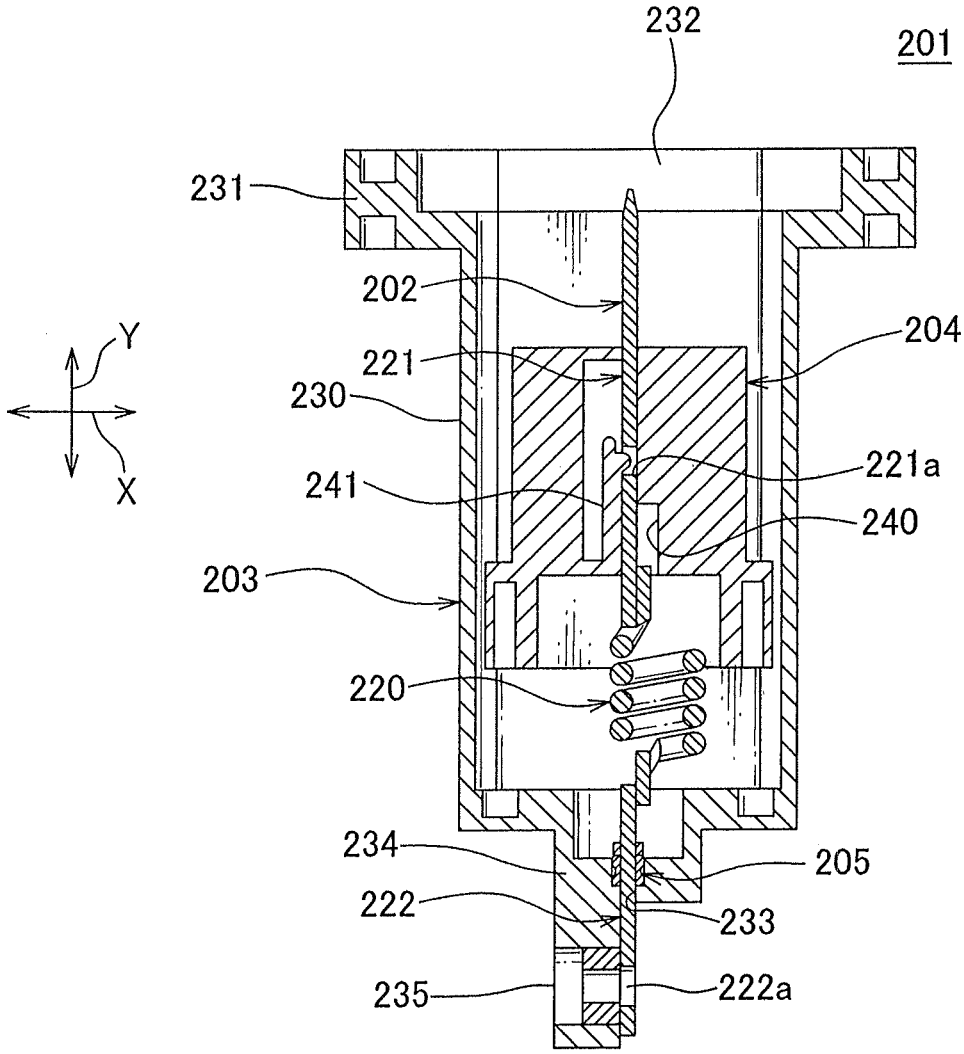
[FIG. 9] A sectional view taken on line B-B of FIG. 8.

A connector 201 according to a third embodiment of the present invention will be explained with reference to FIGS. 8 and 9.

The connector 201 is fitted with a mating connector (not shown) and electrically connected to the mating connector. Further, an arrow Y of FIGS. 8 and 9 indicates a fitting direction between the connector 201 and the mating connector, and an arrow X indicates a direction perpendicular to the fitting direction. As shown in FIGS. 8 and 9, the connector 201 includes: a terminal 202; an inner housing 204 receiving and holding a later-described first electric connecting part 221 of the terminal 202; and an outer housing 203 receiving the terminal 202 and the inner housing 204.

The terminal 202 is provided with the first electric connecting part 221 for electrically connected to the terminal of the mating connector, a second electric connecting part 222 for electrically connected to a not-shown terminal (for example, a terminal as a component of an electric circuit of an electronic device), and a coupling part 220 for movably and electrically connecting the first electric connecting part 221 and the second electric connecting part 222.

The first electric connecting part 221 is made of conductive metal, and formed in a bar shape, namely, a male type. This first electric connecting part 221 is inserted into the terminal of the mating connector.

The second electric connecting part 222 is made of conductive metal, and formed in a plate shape. Further, a bolt hole 222*a* is provided on an end of the second electric connecting part 222 away from the first electric connecting part 221. This second electric connecting part 222 is overlapped with the not-shown terminal, and a bolt is attached to the bolt hole 222*a*, thereby the second electric connecting part 222 is electrically connected to the terminal.

The coupling part 220 is composed of a coil spring in which a conductive wire is wound in a spiral shape. One end of the coupling part 220 is welded to an end of the first electric connecting part 221 near the second electric connecting part 222, and the other end of the coupling part 220 is welded to an end of the second electric connecting part 222 near the first electric connecting part 221, thereby the coupling part 220 is electrically connected to the first electric connecting part 221 and the second electric connecting part 222.

Because the coupling part 220 having above-described structure is composed of the coil spring, the coupling part 220 is elastically deformable in all directions. Incidentally, "all directions" means an arranging direction of first electric connecting part 221 and the second electric connecting part 222, and a direction crossing the arranging direction. When the coupling part 220 is elastically deformed, the coupling part 220 movably couples the first electric connecting part 221 and the second electric connecting part 222 in all directions, namely, the arranging direction of the first electric connecting part 121 and the second electric connecting part 122, and the direction crossing the arranging direction.

The inner housing 204 is made of synthetic resin, and formed in a tubular shape having a terminal receiving chamber 240 for receiving the first electric connecting part 221. Further, a locking arm 141 for locking with a locking hole 221*a* provided on the center in a longitudinal direction of the first electric connecting part 221 to attach the first electric connecting part 221 is formed on an inside of the terminal receiving chamber 240.

The outer housing 203 is made of synthetic resin. The outer housing 203 integrally includes: a tubular receiving part 230 receiving movably in all directions the inner housing 204 in which the first electric connecting part 221 is received and held; a flange 231 extending toward an outside of the receiving part 230 along the arrow X direction from one end of the receiving part 230 in the arrow Y direction; a fixing part 234 to which the second electric connecting part 222 is fixed; and a terminal exposed part 235.

A terminal insertion hole 233 extending in the arrow Y direction is formed on the center of the fixing part 234. A center part in a longitudinal direction of the second electric connecting part 222 is positioned in the terminal insertion hole 233. Further, an end of the second electric connecting part 222 positioned away from the first electric connecting part 221 is exposed outside of the outer housing 203 via the terminal insertion hole 233. Further, a circular packing 205 is attached to the center in the longitudinal direction of the second electric connecting part 222. By press-fitting the packing 205 into the terminal insertion hole 233, the second electric connecting part 222 is fixed to the fixing part 234.

The terminal exposed part 235 is extended from an end face of the fixing part 234 away from the receiving part 230. An end of the second electric connecting part 222 disposed outside of the terminal insertion hole 233 is positioned on a surface of the terminal exposed part 235. Further, a nut for screwing onto a bolt to be inserted into the bolt hole 222*a* is embedded in the terminal exposed part 235.

The receiving part 230 is extended in a tubular shape in the arrow Y direction from an end wall of the fixing part 234 away from the terminal exposed part 235. Further, the terminal 202 is received in the receiving part 230 in a manner that the first electric connecting part 221 is positioned at one end of the receiving part 230, and the coupling part 220 is positioned at the other end of the receiving part 230. Further, the inner housing 204 receiving and holding the first electric connecting part 221 is received in the receiving part 230 with a gap between the inner housing 204 and an inner side wall of the receiving part 230. This gap is used for moving the first electric connecting part 221 in a direction crossing the arrow Y. Further, the mating connector is inserted into the receiving part 230 from an opening 232 positioned at the one end of the receiving part 230.

Further, in the terminal 202, because the first electric connecting part 221 and the second electric connecting part 222 are coupled together with the coupling part 220 which is elastically deformable in all directions, while the second electric connecting part 222 is fixed to the fixing part 234, the first electric connecting part 221 is movable in above-described all directions.

According to the connector 201 having above-described structure, when fitting with the mating connector, the coupling part 220 is elastically deformed as the first electric connecting part 221 is inserted into the terminal of the mating connector, thereby the first electric connecting part 221 and the inner housing 204 are moved in the receiving part 230 to absorb a position gap in all directions generated between the terminal of the mating connector and the first electric connecting part 221. Accordingly, the connector 201 of the present invention can be surely fitted with the mating connector.

Further, according to the connector 201 of the present invention, an impact load applied to the first electric connecting part 221 and the inner housing 204 by fitting the connector 201 and the mating connector together can be absorbed by an elastic deformation of the coupling part 220.

Further, according to the connector 201 of the present invention, because the second electric connecting part 222 is electrically connected to the first electric connecting part 221 via the coupling part 220, even when the first electric connecting part 221 is moved in any direction due to the fitting with the mating connector, the second electric connecting part 222 is not moved, thereby the connection reliability between the second electric connecting part 222 and a not-shown terminal electrically connected to the second electric connecting part 222 is prevented from being reduced.

Further, according to the connector 201 of the present invention, when the coupling part 220 absorbs the vibration applied to the outer housing 203, the vibration is hard to be transmitted to the terminal 202, thereby the connection reliability between the terminal 202 and the terminal of the mating connector is prevented from being reduced.

Further, in the second and third embodiments, the second electric connecting parts 122, 222 are electrically connected to the terminal. However, the second electric connecting part of the terminal of the present invention may be electrically connected to an electric wire.

(Fourth Embodiment)

A connector according to a fourth embodiment of the present invention will be explained with reference to FIGS. 10 to 16.

Figure 10:
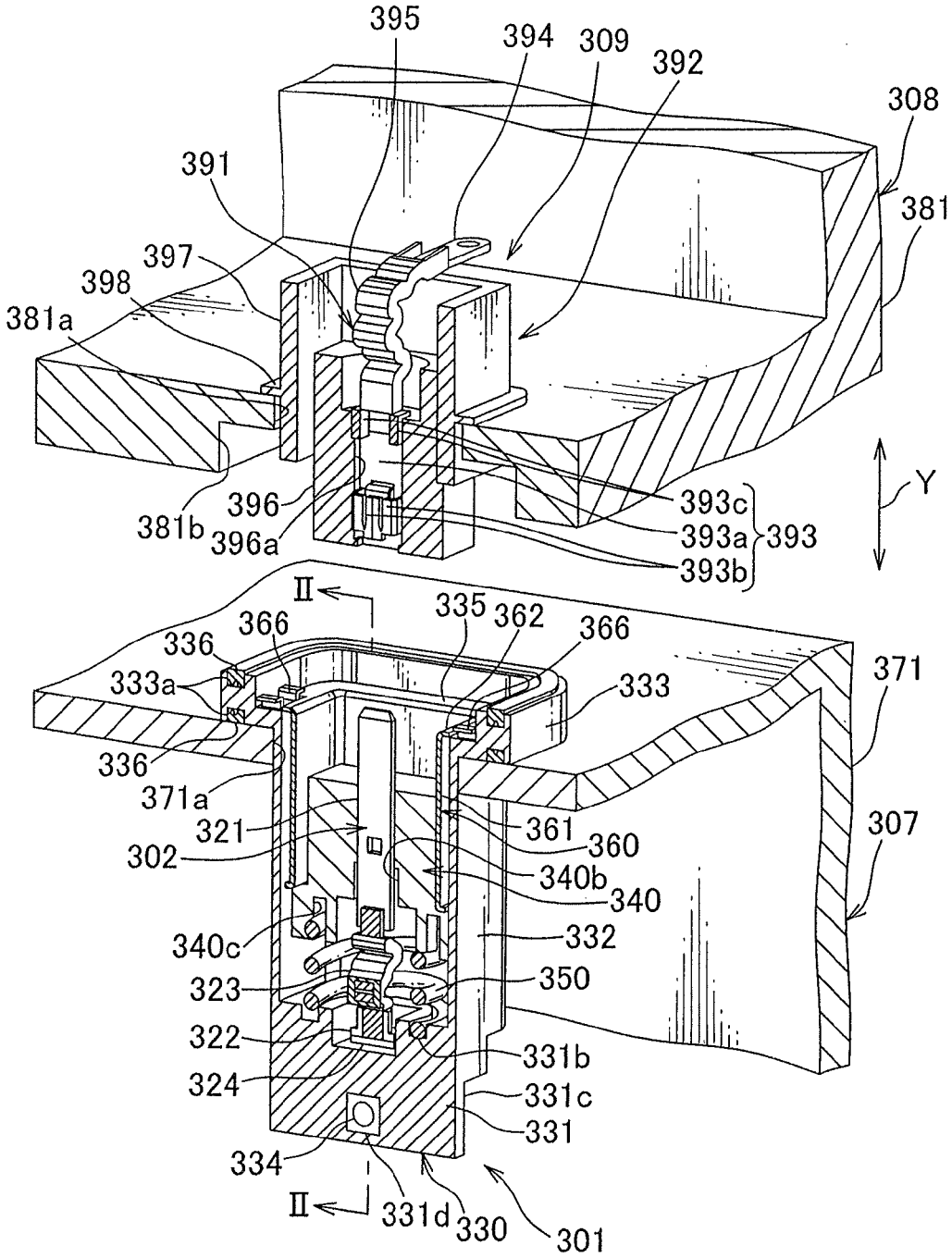
[FIG. 10] A sectional perspective view showing a connector according to a fourth embodiment of the present invention.

As shown in FIG. 10, a connector 301 is attached to a case 371 of a motor 307 mounted on an electric vehicle or a hybrid vehicle, and fitted with, namely, electrically connected to a mating connector 309 attached to a case 381 of an inverter 308. Namely, when the inverter 308 is mounted on the motor 307, the connector 1 is directly connected to the mating connector 309 integrally provided with the inverter 308.

Further, the mating connector 309 is attached to a connector receiving hole 381*a* provided on the case 381 of the inverter 308. The connector receiving hole 381*a* penetrates an outer wall of the case 381, and is formed in a shape following an outer surface of the mating connector 309. Further, a concave part 381*b* at which a later-described flange 333 of the connector 301 is positioned is provided around the connector receiving hole 381*a* of the case 381.

The mating connector 309 includes: a terminal 391; and a housing 392 receiving the terminal 391. The terminal 391 is provided with a female type electric contact part 393 into which a terminal 302 of the connector 301 is inserted and electrically connected to the terminal 302, a circuit connecting part 394 disposed in the case 381 and electrically connected to an electric circuit of the inverter 308, and a coupling part 395 coupling the electric contact part 393 and the circuit connecting part 394 together. Further, the electric contact part 393 is provided with a rectangular flat plate part 393*a*, an elastic piece 393*b* for clipping the terminal 302 of the connector 301 between the elastic piece 393*b* and the flat plate part 393*a*, and a crimping piece 393*c* for crimping the coupling part 395 between the crimping piece 393*c* and the flat plate part 393*a*. The housing 392 is integrally provided with a box-shaped housing main body 396 having a terminal receiving chamber 396*a* for receiving the electric contact part 393, a rectangular-tubular-shaped hood part 397 continued to an outer periphery of the housing main body 396, and a flange 398 extending vertically from an outer periphery of the hood part 397. The flange 398 is overlapped with an inner surface of the case 381, while the housing main body 396 and the hood part 397 are inserted into the connector receiving hole 381*a*.

The above-described mating connector 309 and the connector 301 are fitted with each other along the arrow Y direction of FIG. 1.

Figure 11:
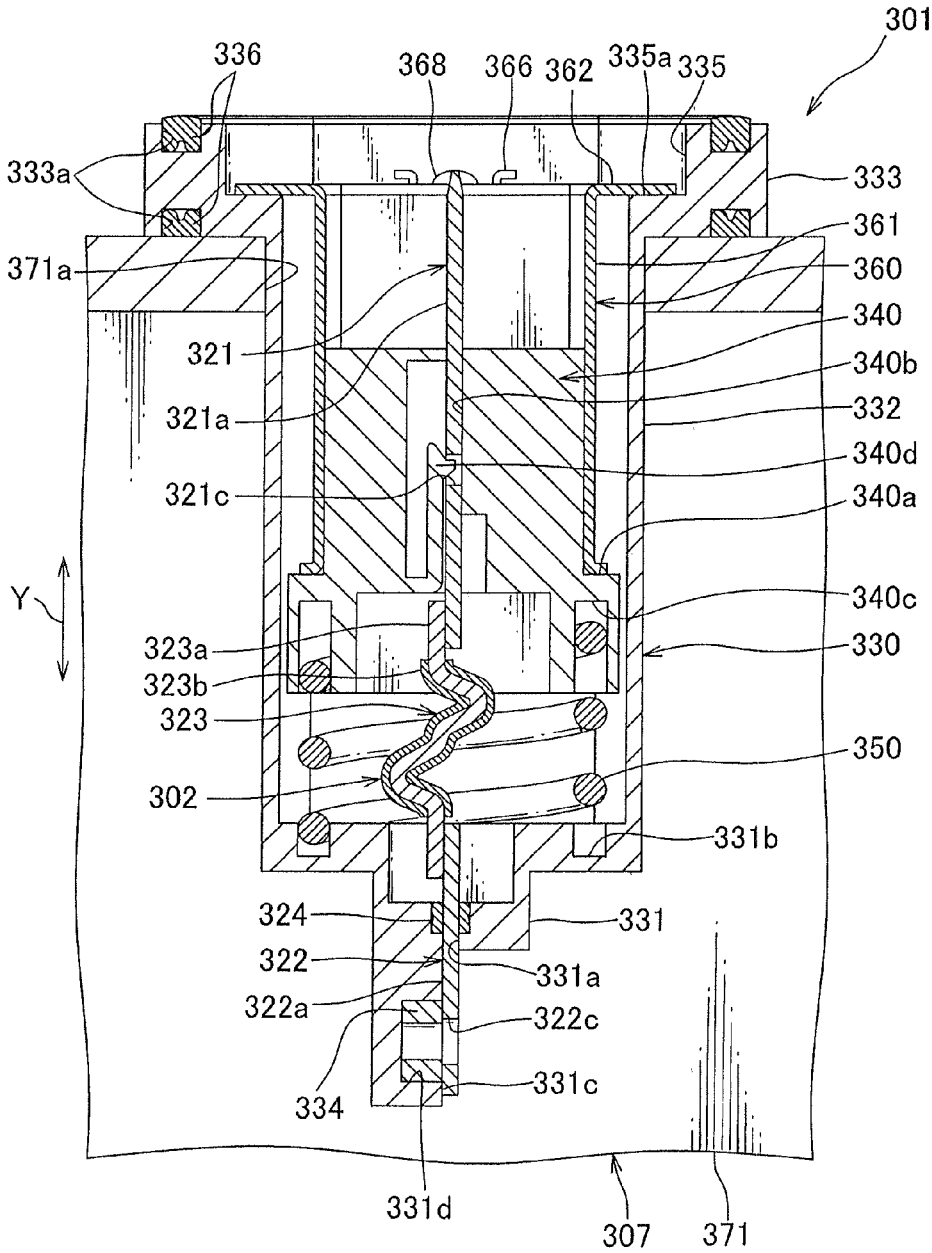
[FIG. 11] A sectional view taken on line II-II of FIG. 10.

As shown in FIGS. 10 and 11, the connector 301 is attached to a connector receiving hole 371*a* provided on the case 371 of the motor 307. The connector receiving hole 371*a* penetrates an outer wall of the case 371, and is formed in a shape following an outer surface of the connector 301.

The connector 301 includes: the terminal 302; an inner housing 340 receiving and holding a later-described first electric connecting part 321 of the terminal 302; an outer housing 330 receiving the terminal 302 and the inner housing 340; a coil spring 350 as a biasing member; and a holder 360 attached to the outer housing 330.

The terminal 302 is provided with the first electric connecting part 321 received and held in the inner housing 340, disposed near the mating connector 309 in the outer housing 330, and electrically connected to the electric contact part 393 of the terminal 391 of the mating connector 309, a second electric connecting part 322 disposed further away from the mating connector 309 than the first electric connecting part 321 in the outer housing 330, and electrically connected to the electric circuit of the motor 307, and a coupling part 323 movably coupling and electrically connecting the first electric connecting part 321 and the second connecting part 322.

The first electric connecting part 321 is made by pressing a metal plate, and formed separately from the second electric connecting part 322. As shown in FIG. 11, the first electric connecting part 321 is provided with a rectangular-plate-shaped flat plate part 321*a*. One end of the flat plate part 321*a* disposed away from the second electric connecting part 322 is positioned at an outside of the inner housing 340, and inserted into the electric contact part 393 of the terminal 302 of the mating connector 309 to be electrically connected to the electric contact part 393. Further, a locking hole 321*c* for locking a later-described locking arm 340*d* of the inner housing 340 is provided on a center part of the flat plate part 321*a* positioned at an inside of the inner housing 340.

The second electric connecting part 322 is made by pressing a metal plate. The second electric connecting part 322 is provided with a rectangular-plate-shaped flat plate part 322*a*. A one end of the flat plate part 322*a* disposed away from the first electric connecting part 321 is exposed to an outside of the outer housing 330. Further, a bolt hole 322*c* is provided on the one end of the flat plate part 322*a*. A terminal composing the electric circuit of the motor 307 is overlapped with the one end of the flat plate part 322*a*. By inserting a bolt into the bolt hole provided on the terminal and the bolt hole 322*c*, the one end of the flat plate part 322*a* is electrically and mechanically connected to the terminal of the motor 307. Further, a center part in a longitudinal direction of the flat plate part 322*a* is positioned at a later-described terminal insertion hole 331*a* of the outer housing 330. A packing 324 for keeping a space between an inner wall of the terminal insertion hole 331*a* and the second electric connecting part 322 watertight when the packing 324 closely contacts the inner wall of the terminal insertion hole 331*a* is attached to the center part of the flat plate part 322*a*.

The coupling part 323 is composed of a braided wire 323*a* and a cover 323*b* covering the braided wire 323*a*. The braided wire 323*a* is made by braiding a plurality of metallic element wires in a band shape, and is flexible. Further, the cover 323*b* is formed in a thin shape in order to be bent easily. Such a coupling part 323 is so formed as to be more flexible than the first electric connecting part 321 and the second electric connecting part 322. Further, the coupling part 323 is so formed as to be longer than a distance between the first electric connecting part 321 and the second electric connecting part 322 received in the outer housing 330. Namely, the coupling part 323 is received in the outer housing 330 while being bent. Further, at both ends of the coupling part 323, the cover 323*b* is stripped and the braided wire 323*a* is exposed. By welding both ends of the exposed braided wire 323*a* to the first electric connecting part 321 and the second electric connecting part 322, the coupling part 323 is electrically and mechanically connected to the first electric connecting part 321 and the second electric connecting part 322.

Further, according to the present invention, because the coupling part 323 is composed of the braided wire 323*a*, the coupling part 323 can be more flexible than a round electric wire including: a core wire made by twisting a plurality of element wires; and a cover covering the core wire. Further, according to the present invention, because the coupling part 323 is composed of the braided wire 323*a*, the coupling part 323 can be deformed in all directions.

The inner housing 340 is made of insulating synthetic resin. The inner housing 340 is formed in a box shape of which outer diameter is smaller than an inner diameter of a receiving part 332 of the outer housing 330, and received movably in all directions in the receiving part 332. Further, a diameter of the other end of the inner housing 340 away from the mating connector 309 is larger than that of the one end of the inner housing 340 near the mating connector 309. Further, a flat abutting wall 340*a* extending in a direction perpendicular to the arrow Y direction is formed on an outer peripheral wall between the one end and the other end of the inner housing 340. The abutting wall 340*a* abuts on an end wall of the holder 360.

Further, the inner housing 340 is provided with a terminal receiving chamber 340*b* for receiving the first electric connecting part 321, and a spring receiving groove 340*c*. The terminal receiving chamber 340*b* penetrates the inner housing 340 in the arrow Y direction. Further, a locking arm 340*d* for locking with a locking hole 321*a* provided on the center in a longitudinal direction of the first electric connecting part 321 to attach the first electric connecting part 321 is formed in the terminal receiving chamber 340*b*. The spring receiving groove 340*c* is formed in a concave shape from an end wall of the inner housing 340 away from the mating connector 309. The spring receiving groove 340*c* is formed in a ring shape in a plan view, and an opening of the terminal receiving chamber 340*b* is positioned at the center of the ring shape. The other end of the coil spring 350 is received in an inside of the spring receiving groove 340*c*.

The outer housing 303 is made of insulating synthetic resin. The outer housing 303 integrally includes: a tubular receiving part 332 receiving movably in all directions the inner housing 304 in which the first electric connecting part 321 is received and held; a flange 333 extending toward an outside of the receiving part 332 from one end of the receiving part 332 positioned at the mating connector 309 side; a fixing part 331 to which the second electric connecting part 322 is fixed; and a terminal exposed part 331*c*.

As shown in FIG. 11, a terminal insertion hole 331*a* extending in the arrow Y direction and a spring receiving groove 331*b* are formed on the center of the fixing part 331. A center part in a longitudinal direction of the second electric connecting part 322 is positioned in the terminal insertion hole 331*a*. Further, an end of the second electric connecting part 322 positioned away from the first electric connecting part 321 is exposed outside of the outer housing 330 via the terminal insertion hole 331*a*. Further, a circular packing 324 is attached to the center in the longitudinal direction of the second electric connecting part 322. By press-fitting the packing 324 into the terminal insertion hole 331*a*, the second electric connecting part 322 is fixed to the fixing part 331. The spring receiving groove 331*b* is formed in a concave shape from an end wall facing the mating connector 309. The spring receiving groove 331*b* is formed in a ring shape in a plan view, and an opening of the terminal receiving chamber 331*a* is positioned at the center of the ring shape. The one end of the coil spring 350 is received in an inside of the spring receiving groove 331*b*.

The terminal exposed part 331*c* is extended from an end face of the fixing part 331 away from the receiving part 332. An end of the second electric connecting part 322 disposed outside of the terminal insertion hole 331*a* is positioned on a surface of the terminal exposed part 331*c*. Further, a nut 334 for screwing onto a bolt to be inserted into the bolt hole 322*c* is embedded in a bolt hole 331*d* provided on the terminal exposed part 331*c*.

The receiving part 332 is extended in a rectangular tubular shape in the arrow Y direction from an end wall of the fixing part 331 away from the terminal exposed part 331*c*. Further, the terminal 302 is received in the receiving part 332 in a manner that the first electric connecting part 321 is positioned at one end of the receiving part 332, and the coupling part 323 is positioned at the other end of the receiving part 332. Further, the inner housing 340 receiving and holding the first electric connecting part 321 is received in the receiving part 332 with a gap between the inner housing 340 and an inner side wall of the receiving part 332. This gap is used for moving the first electric connecting part 321 in a direction crossing the arrow Y. Further, the mating connector is inserted into the receiving part 332 from an opening positioned at the one end of the receiving part 332.

The flange 333 is overlapped with an outer surface of the case 371 while the receiving part 332 is inserted into the connector receiving hole 371*a*. Further, the flange 333 is positioned on the concave part 381*b* of the case 371, while the connector 301 and the mating connector 309 are fitted with each other. Further, attaching grooves 333*a* are respectively provided on a lower wall on which the flange 333 is overlapped with the case 371, and an upper wall opposite to the lower wall on which the flange 333 is overlapped with the case 381 of the inverter 308. Each attaching groove 333*a* is formed in a ring shape extending around the whole circumference of the flange 333. Further, a ring shaped packing 336 is attached to the attaching groove 333*a* provided on the lower wall of the flange 333. This packing 336 is closely attached to an outer surface of the case 371 to keep a space between the case 371 and the outer housing 330 watertight. Further, a ring shaped packing 336 is attached to the attaching groove 333*a* provided on the upper wall of the flange 333. This packing 336 is closely attached to an outer surface of the case 381 of the inverter 308 to keep a space between the case 381 and the outer housing 330 watertight.

Figure 13:
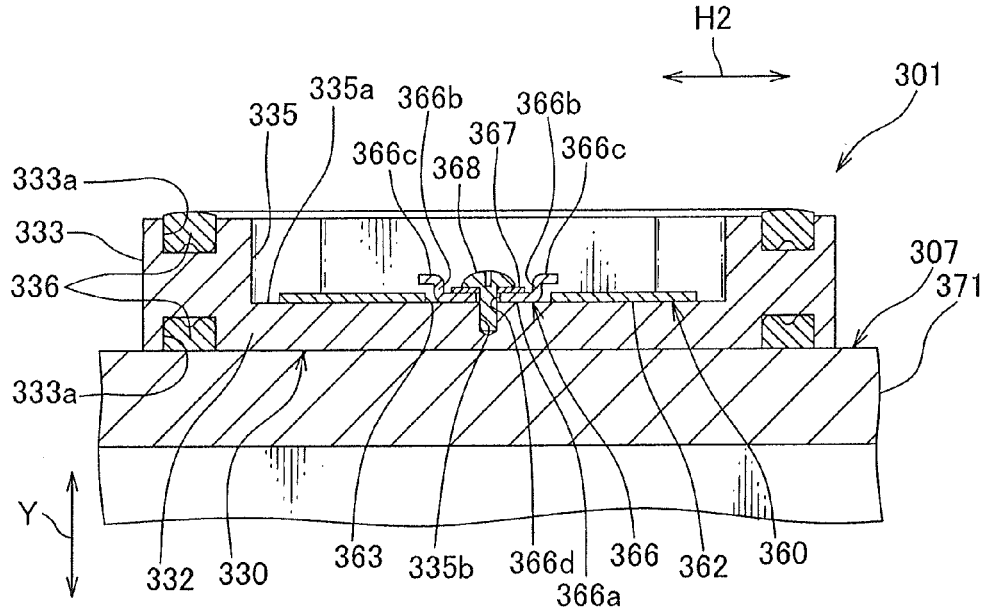
[FIG. 13] A sectional view taken on line TV-IV of FIG. 12.

Further, a concave part 335 is formed on the upper wall of the flange 333. A bottom wall 335*a* of the concave part 335 is formed in a flat shape along a direction perpendicular to the arrow Y direction. A later-described flange 362 of the holder 360 is overlapped with the bottom wall 335*a*. Further, as shown in FIG. 13, a pair of bolt holes is provided on the bottom wall 335*a*.

The coil spring 350 is received in the receiving part 332 in a direction that the center axis direction thereof is parallel to the arrow Y direction, namely, a elastically deformation direction is parallel to the arrow Y direction. Further, the coil spring 350 is positioned at between the fixing part 331 and the inner housing 340. A one end of the coil spring 350 is positioned in the spring receiving groove 331*b* of the fixing part 331. The other end of the coil spring 350 is positioned in the spring receiving groove 340*c* of the inner housing 340. Such a coil spring 350 biases the inner housing 340 received in the receiving part 332 toward the mating connector 309.

Further, as shown in FIG. 11, before the connector 301 is fitted with the mating connector 309, the abutting wall 340*a* of the inner housing 340 which is biased by the coil spring 350 abuts on an end wall of the holder 360.

The holder 360 is made of metallic material which is harder than synthetic resin used for the outer housing 330 and the inner housing 340. Further, the holder 360 is made by pressing a metal plate. This holder 360 is provided with a tube part 361 received in the receiving part 332, and the flange 362 overlapped with the bottom wall of the concave part 335.

The tube part 361 is formed in a rectangular tubular shape of which outer diameter is smaller than an inner diameter of the receiving part 332. Further, an inner diameter of the tube part 361 is formed larger than an outer diameter of the one end of the inner housing 340, and smaller than an outer diameter of the other end of the inner housing 340.

Figure 12:
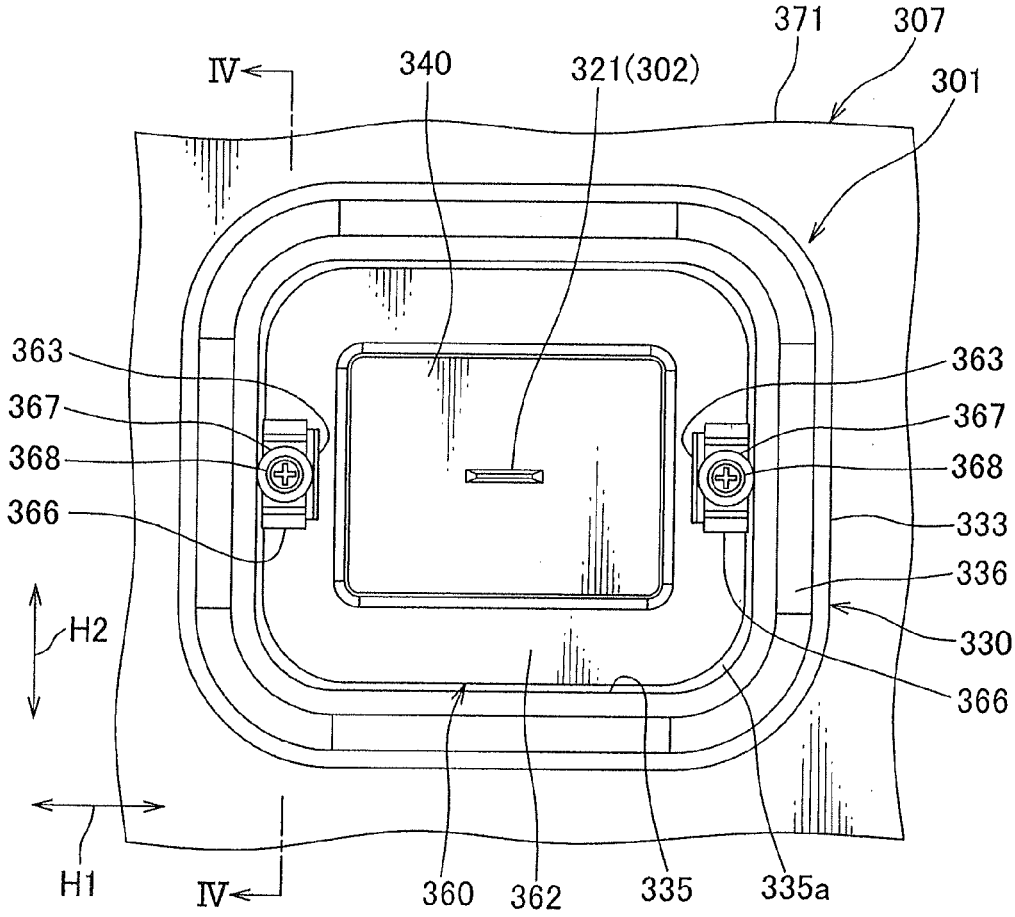
[FIG. 12] A top view of the connector shown in FIG. 10.

The flange 362 is formed on an end of the tube part 361 at the mating connector 309 side. The flange 362 is projected in a flange shape from an outer periphery of the tube part 361, and formed in a ring shape around the whole circumference of the tube part 361. As shown in FIGS. 12 and 13, a pair of holes 363 is formed on the flange 362. The pair of holes 363 is formed by notching an outer edge of the flange 362 in a rectangular shape, and formed to position the center axis of the holder 360 therebetween.

As shown in FIGS. 12 and 13, when a fastener 366, a bolt 368, and a washer 367 are attached to the bottom wall 335*a* of the concave part 335, such a holder 360 is attached to the outer housing 330 movably in a direction perpendicular to the fitting direction of the connector 301 and the mating connector 309, namely, the arrow Y direction.

The fastener 366 is made by pressing a metal plate. As shown in FIGS. 12 and 13, the fastener 366 is composed of a rectangular plate part 366*a* smaller than the hole 363, a pair of standing pieces 366*b* standing in the same direction from both ends in a longitudinal direction of the plate part 366*a*, and a pair of extending pieces 366*c* extending in a direction separating from each other (the longitudinal direction of the plate part 366*a*) from ends of the pair of standing pieces 366*b* away from the plate part 366*a*. A bolt hole 366*d* for inserting the bolt 368 is formed on the center of the plate part 366*a*. Further, a whole size in the longitudinal direction of the fastener 366 is formed larger than a size in the longitudinal direction of the hole 363. Further, a distance between a surface of the plate part 366*a* witch is overlapped with the bottom wall 335*a* and a surface of the extending piece 366*c* facing the bottom wall 335*a* is larger than a thickness of the flange 362. Namely, the fastener 366 is so formed that the surface of the extending piece 366*c* does not contact the surface of the flange 362.

When the holder 360 is attached to the outer housing 330 with the above-described fastener 366, the tube part 361 of the holder 360 is inserted into the receiving part 332, and the flange 362 is overlapped with the bottom wall 335*a* of the concave part 335, and then, the plate part 366*a* of the fastener 366 is overlapped with the bottom wall 335*a* exposed from the hole 363. At this time, the fastener 366 and the hole 363 are overlapped with each other in a manner that the longitudinal direction of the fastener 366 and the longitudinal direction of the hole 363 are parallel to each other. Then, the bolt hole 366*d* of the plate part 366*a* is overlapped with the bolt hole 335*b* of the concave part 335. Then, the bolt 368 is screwed into the bolt holes 335*b*, 366*d* via the washer 367.

Because a surrounding area of the hole 363 is positioned between the bottom wall 335*a* and the extending piece 366*c*, the holder 360 attached to the outer housing 330 in above-described manner is prevented from falling out of the outer housing 330. Further, the fastener 366 is so formed that a gap is generated between an outer edge of the plate part 366*a* and an inner edge of the hole 363, and the extending piece 366*c* does not contact the surface of the flange 362. Therefore, the holder 360 is movable along a surface direction of the bottom wall 335*a* (for example, an arrow H1 direction or an arrow H2 direction shown in FIG. 1, perpendicular to the arrow Y direction) in a manner that the flange 362 slides on the bottom wall 335*a*. Thus, the holder 360 is attached to the outer housing 330 movably in a direction perpendicular to the fitting direction of the connector 301 and the mating connector 309, namely, the arrow Y direction.

Further, the holder 360 receives the one end of the inner housing 340 in the tube part 361, while the holder 360 is attached to the outer housing 330. Further, because the inner housing 340 is biased toward the mating connector 309 with the coil spring 350, the abutting wall 340*a* abuts on the end wall of the tube part 361 away from the flange 362. Thereby, the inner housing 340 is prevented from falling out of the receiving part 332. Namely, the end wail of the tube part 361 away from the flange 362 corresponds to the stopper described in claims. Further, when the holder 360 is moved in a direction perpendicular to the arrow Y direction, the inner housing 340 is moved in the receiving part 332 together with the holder 360.

Next, an assembling method of the above-described connector 301 will be explained. First, the terminal 302 is attached to the inner housing 340 by inserting the first electric connecting part 321 of the terminal 302 into the terminal receiving chamber 340*b* of the inner housing 340. Further, the packing 324 is attached to the second electric connecting part 322 of the terminal 302. Further, the packing 336 is attached to the attaching groove 333*a* of the outer housing 330. Next, the coil spring 350 is inserted into the receiving part 332. Then, the inner housing 340 having the terminal 302 and the first electric connecting part 321 is inserted into the outer housing 330 via an opening of the receiving part 332, the second electric connecting part 322 is inserted into the terminal insertion hole 331*a* of the fixing part 331, and the inner housing 340 having the first electric connecting part 321 is inserted into the receiving part 332. Then, the one end of the inner housing 340 is received in the tube part 361 by inserting the holder 360 into the receiving part 332. Further, the coil spring 350 is elastically deformed by pushing the abutting wall 340*a* of the inner housing 340 with the end wall of the tube part 361, and the flange 362 is overlapped with the bottom wall 335*a* of the concave part 335. Then, as described above, the holder 360 is attached to the outer housing 330 with the fastener 366. Thus, the connector 301 is assembled.

The connector 301 assembled as described above is inserted into the connector receiving hole 371*a*. The flange 333 of the outer housing 330 is overlapped with the outer surface of the case 371, and attached to the case 371 with the bolt. Then, the terminal as a component of the electric circuit of the motor 307 is overlapped with the second electric connecting part 322 positioned on the surface of the terminal exposed part 331*c*, and the bolt is screwed into the bolt hole of the terminal, the bolt hole 322*c*, and the bolt hole 331*d*, thereby the electric circuit of the motor 307 and the second electric connecting part 322 are electrically connected to each other.

Figure 14:
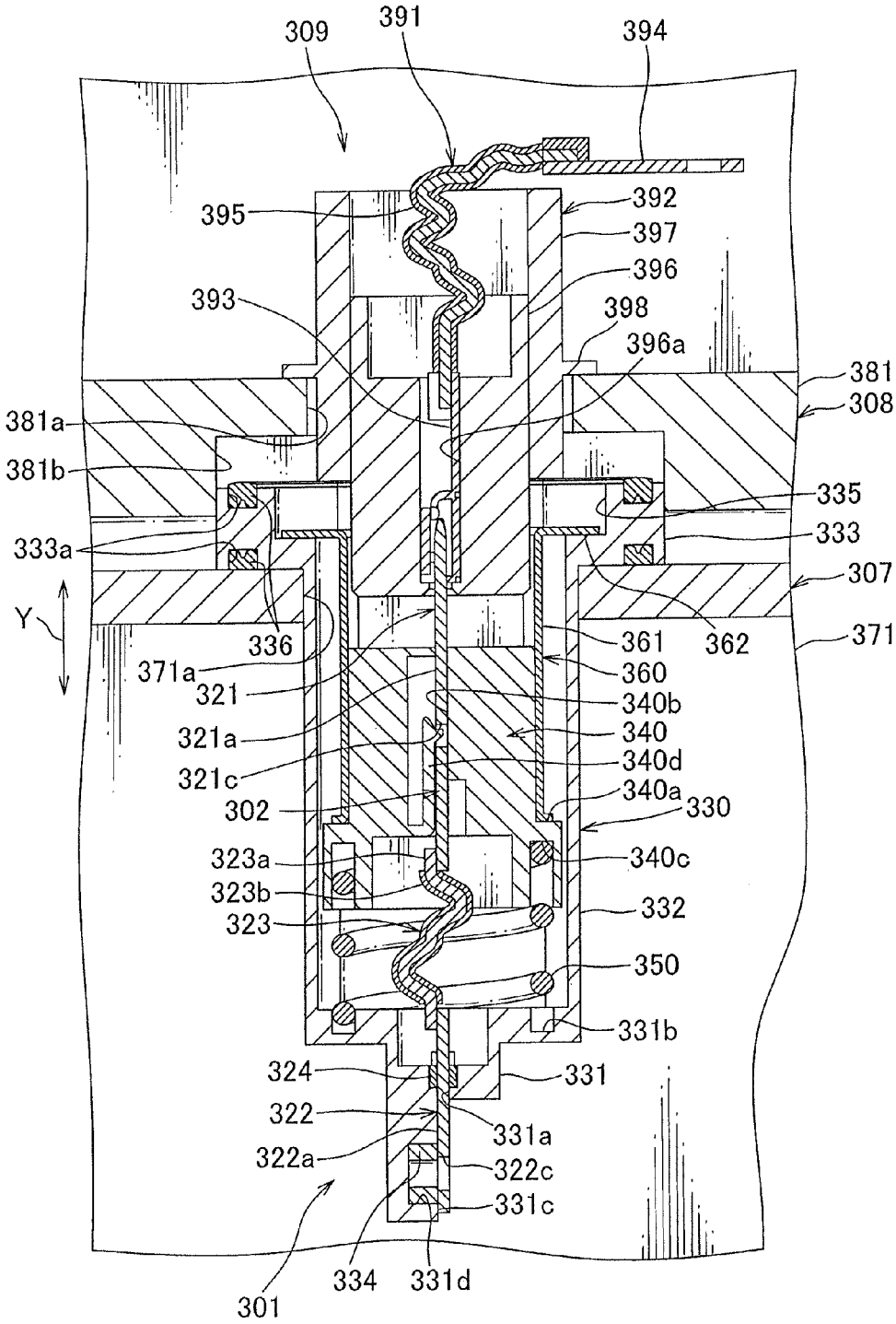
[FIG. 14] A sectional view showing a condition that the connector shown in FIG. 10 is started to be fitted with a mating connector.

Next, a condition when the connector 301 and the mating connector 309 are fitted with each other will be explained. As shown in FIG. 14, when the mating connector 309 attached to the case 381 of the inverter 308 is moved close to the connector 301 attached to the case 371 of the motor 307 along the arrow Y direction, the housing main body 396 of the mating connector 309 is inserted into the tube part 361 of the connector 301, and the first electric connecting part 321 is inserted between the flat plate part 393*a* of the electric contact part 393 and the elastic piece 393*b*. Further, at this time, when a position gap is generated between the electric contact part 393 and the first electric connecting part 321, the holder 360 is moved in the arrow H1 direction or the arrow H2 direction to absorb the position gap.

Figure 15:
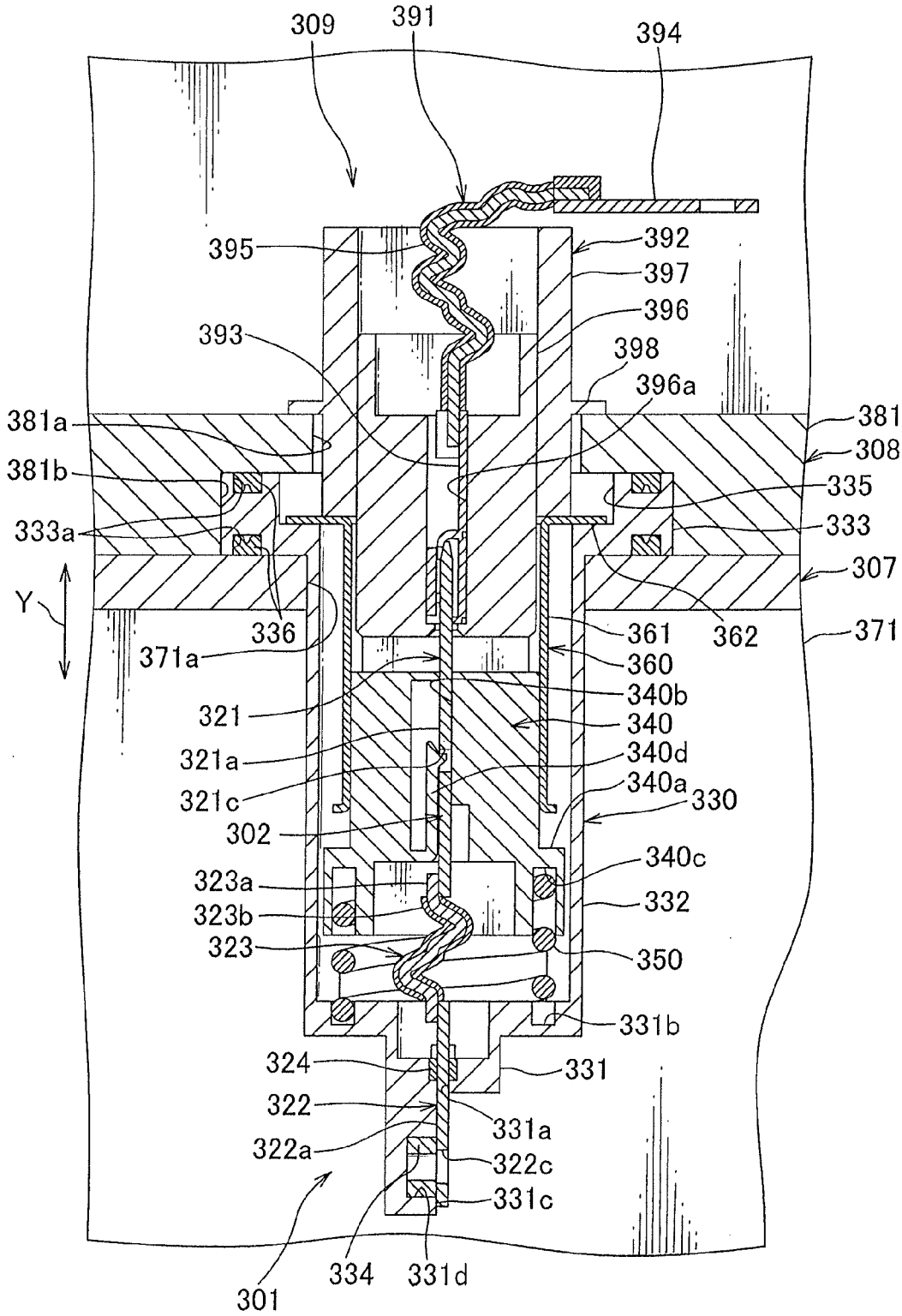
[FIG. 15] A sectional view showing a condition that an inner housing shown in FIG. 14 collides with the mating connector and is moved.

Then, when the mating connector 309 is moved further close to the connector 301, and the case 381 is overlapped with the case 371, as shown in FIG. 15, owing to an impact generated by overlapping the heavy case 381, a front end of the housing main body 396 is hitted against a front end of the inner housing 340, thereby the inner housing 340 is moved toward the fixing part 331, and the coil spring 350 is elastically compressed. At this time, because the coil spring 350 is interposed between the fixing part 331 and the inner housing 340, the inner housing 340 is prevented from hitting against the fixing part 331.

Figure 16:
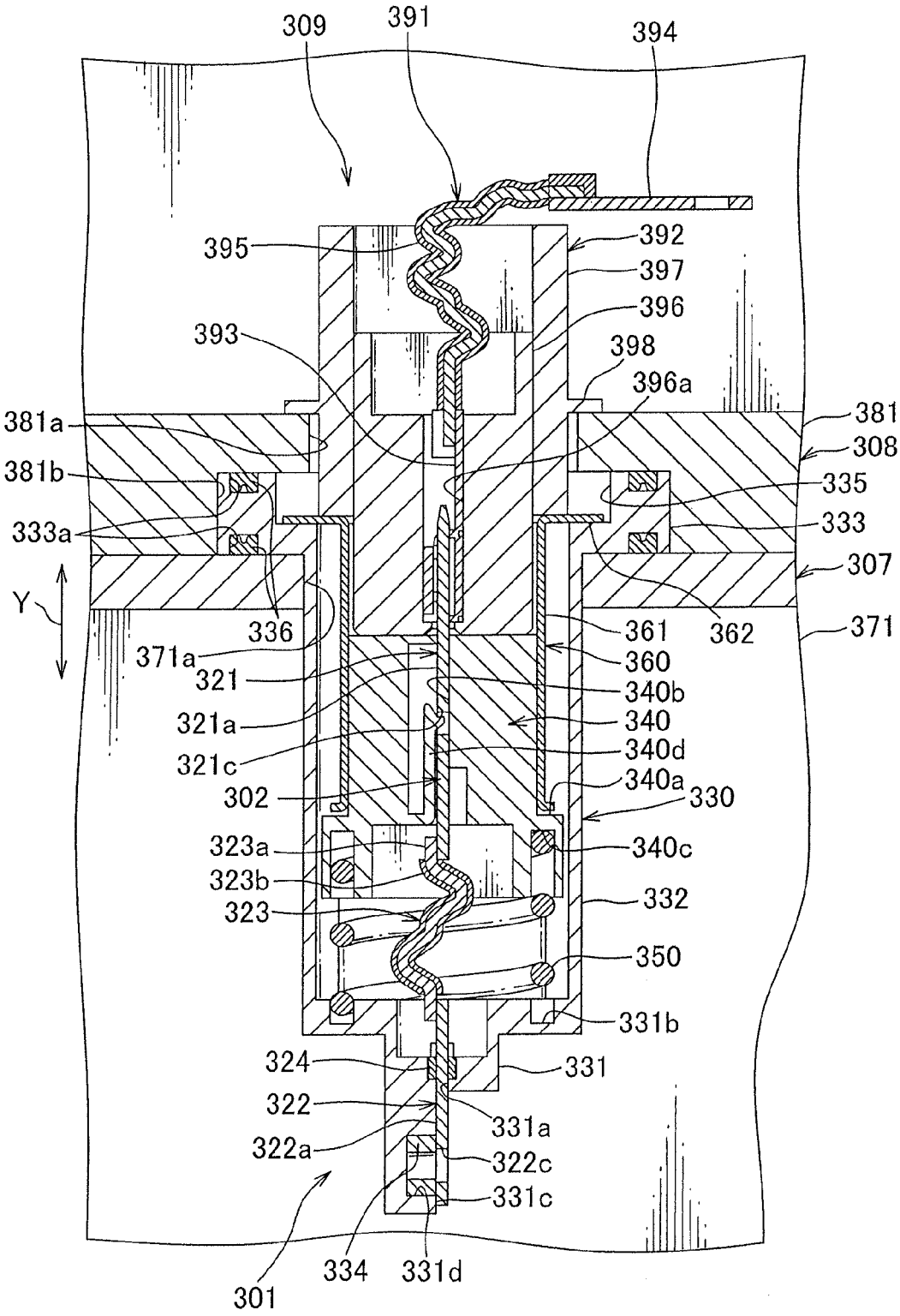
[FIG. 16] A sectional view showing a condition that the inner housing shown in FIG. 15 is pushed back, and the connectors are fully fitted with each other.

Then, as shown in FIG. 16, the inner housing 340 is pushed back toward the mating connector 309 owing to the elastic restoring force of the coil spring 350, and the front end of the inner housing 340 abuts on the front end of the housing main body 396. Further, the first electric connecting part 321 is clipped between the flat plate part 393*a* and the elastic piece 393*b*, thereby the first electric connecting part 321 and the electric contact part 393 are electrically connected to each other. Thus, the connector 301 and the mating connector 309 are fully fitted with each other, and the motor 307 and the inverter 308 are electrically connected to each other.

In this way, according to the connector 301 of the present invention, when the connector 301 is fitted with the mating connector 309, the holder 360 and the inner housing 340 having the first electric connecting part 321 are moved in the receiving part 332, thereby the position gap between the electric contact part 393 and the first electric connecting part 321 is absorbed, and the connector 301 is surely fitted with the mating connector 309. Further, according to the present invention, the connector of the motor 307 and the mating connector 309 of the inverter 308 are directly fitted with each other without using a wiring harness, thereby weight of a vehicle body can be reduced, and $CO_2$ emissions can be reduced.

Further, according to the connector 301 of the present invention, because while the inner housing 340 and the first electric connecting part 321 are moved, the second electric connecting part 322 is fixed to the fixing part 331 and not moved, the connection reliability between the second electric connecting part 322 and the terminal as a component of the electric circuit of the motor 307 and electrically connected to the second electric connecting part 322 is prevented from being reduced. Further, as described above, when the first electric connecting part 321 is moved, because the coupling part 323 having the flexibility is elastically deformed, the first electric connecting part 321 and the second electric connecting part 322 are prevented from being distorted.

Further, because the connector 301 of the present invention includes the holder 360 attached to the receiving part 332, the strength of the receiving part 332 is improved. Therefore, the outer housing 330 and the like can be prevented from being broken by an impact when fitting with the mating connector 309.

Further, because the holder 360 is made of metal, the strength of the holder 360 can be improved, thereby, the strength of the receiving part 332 can be further improved.

Further, because the connector 301 of the present invention includes the coil spring 350, the inner housing 340 is prevented from clashing with the fixing part 331 or the housing main body 396, and from being damaged by an impact generated when fitting with the mating connector 309.

Further, when a vibration is applied to the connector 301, because the coil spring 350 and the coupling part 323 are elastically deformed to absorb the vibration, the connection reliability between the terminal 302 and the terminal 391 of the mating connector 309 is prevented from being reduced.

Further, according to the connector 301 of the present invention, because the end wall of the tube part 361 of the holder 360 abuts on the abutting wall 340*a* of the inner housing 340, the inner housing 340 is prevented from falling out of the receiving part 332.

(Fifth Embodiment)

A connector 401 according to a fifth embodiment of the present invention will be explained with reference to FIG. 17. Further, in FIG. 17, the same components as those in the above-described fourth embodiment are designated the same reference signs and an explanation thereof will be omitted The connector 401 is, similar to the connector 301 explained in the fourth embodiment, attached to the case 371 of the motor 307 mounted on an electric vehicle or a hybrid vehicle, and fitted with, namely, electrically connected to a mating connector attached to a case of an inverter.

Figure 17:
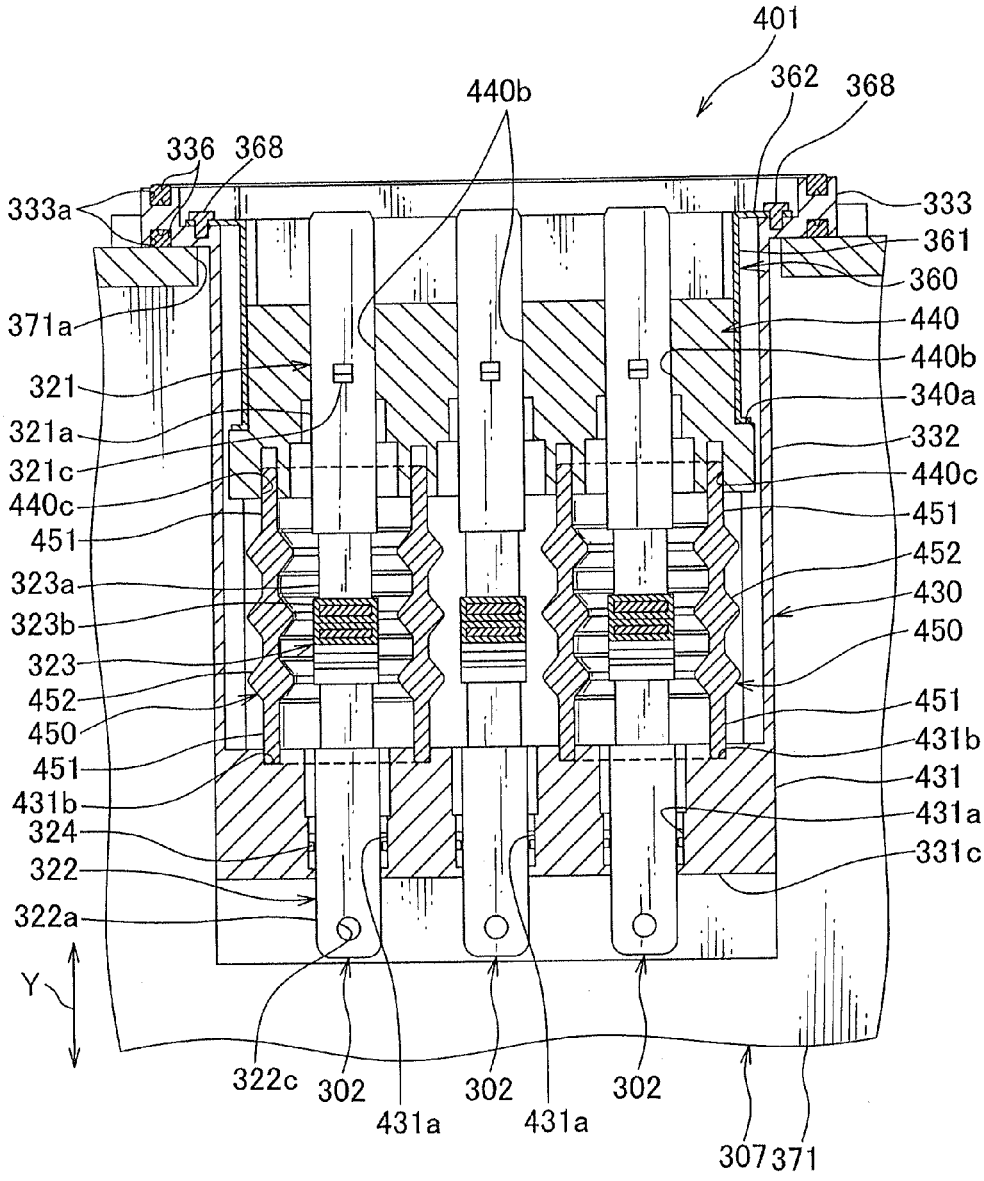
[FIG. 17] A sectional view showing a connector according to a fifth embodiment of the present invention.

As shown in FIG. 17, the connector 401 includes: three terminals 302; an inner housing 440 for receiving and holding first electric connecting parts 321 of these terminals 302; an outer housing 403 provided with a receiving part 332 for movably receiving the inner housing 440 having the first electric connecting parts 321 of the terminals 302 and a fixing part 431 for fixing second electric connecting parts 322 of the terminals 302; an elastic tube 450 as "the biasing member"; and a holder 360. Further, a configuration of the connector 401 is the same as the connector 301 except that the connector 401 is provided with a plurality of terminals 302, and the elastic tube 450 as the biasing member instead of the coil spring 350.

A configuration of the inner housing 440 is the same as the inner housing 340 except that the inner housing 440 is provided with three terminal receiving chambers 440*b*, and two spring receiving grooves 440*c*. The three terminal receiving chambers 440*b* are arranged with gaps with respect to each other. Each terminal receiving chamber 440*b* receives the first electric connecting part 321 of each terminal 302. Two spring receiving grooves 440*c* are provided in a manner that two terminal receiving chambers 440*b* disposed at both ends of the three terminal receiving chambers 440*b* are respectively positioned at the centers of the spring receiving grooves 440*c*.

A configuration of an outer housing 430 is the same as the outer housing 330 of the fourth embodiment except that the fixing part 431 is provided with three terminal insertion holes 431*a* and two spring receiving grooves 431*b*. The three terminal insertion holes 431*a* are arranged with gaps with respect to each other. Each terminal insertion hole 431*a* receives the second electric connecting part 322 of each terminal 302. Two spring receiving grooves 431*b* are provided in a manner that two terminal insertion holes 431*a* disposed at both ends of the three terminal insertion holes 431*a* are respectively positioned at the centers of the spring receiving grooves 431*b*.

The elastic tube 450 is made of elastically deformable synthetic resin such as synthetic rubber, and formed in a tubular shape. Two elastic tubes 450 are provided, and the coupling parts 323 of the terminals 302 disposed at both ends of the three terminals 302 are respectively inserted into the elastic tubes 450. The elastic tube 450 is integrally provided with a pair of tubular parts 451 having a tubular shape, and a bellows-shaped receiving part 452 for coupling the pair of tubular parts 451 together. One tubular part 451 is positioned in the spring receiving groove 431*b* of the outer housing 430, and the other tubular part 451 is positioned in the spring receiving groove 431*b* of the inner housing 440.

According to the connector 401 of this embodiment similar to the fourth embodiment, when the housing main body of the mating connector collides with the inner housing 440, the inner housing 440 is once moved toward the fixing part 331, and then pushed back due to the elastic restoring force of the elastic tube 450. Therefore, the inner housing 440 is prevented from being damaged. Further, the elastic tube 450 is elastically deformed to absorb the vibration. Therefore, the connection reliability between the terminal 302 and the terminal of the mating connector is prevented from being reduced. Further, because the holder 360 is made of metal and has high strength, the holder 360 is prevented from being damaged. Further, by moving the holder 306, the position gap between the terminal 302 of the connector 401 and the terminal of the mating connector can be absorbed.

(Sixth Embodiment)

A connector 501 according to a sixth embodiment of the present invention will be explained with reference to FIG. 18. Further, in FIG. 18, the same components as those in the above-described fourth embodiment are designated the same reference signs and an explanation thereof will be omitted The connector 501 is, similar to the connector 301 explained in the fourth embodiment, attached to a case 571 of a motor 507 mounted on an electric vehicle or a hybrid vehicle, and fitted with, namely, electrically connected to a mating connector 509 attached to a case 581 of an inverter 508.

Figure 18:
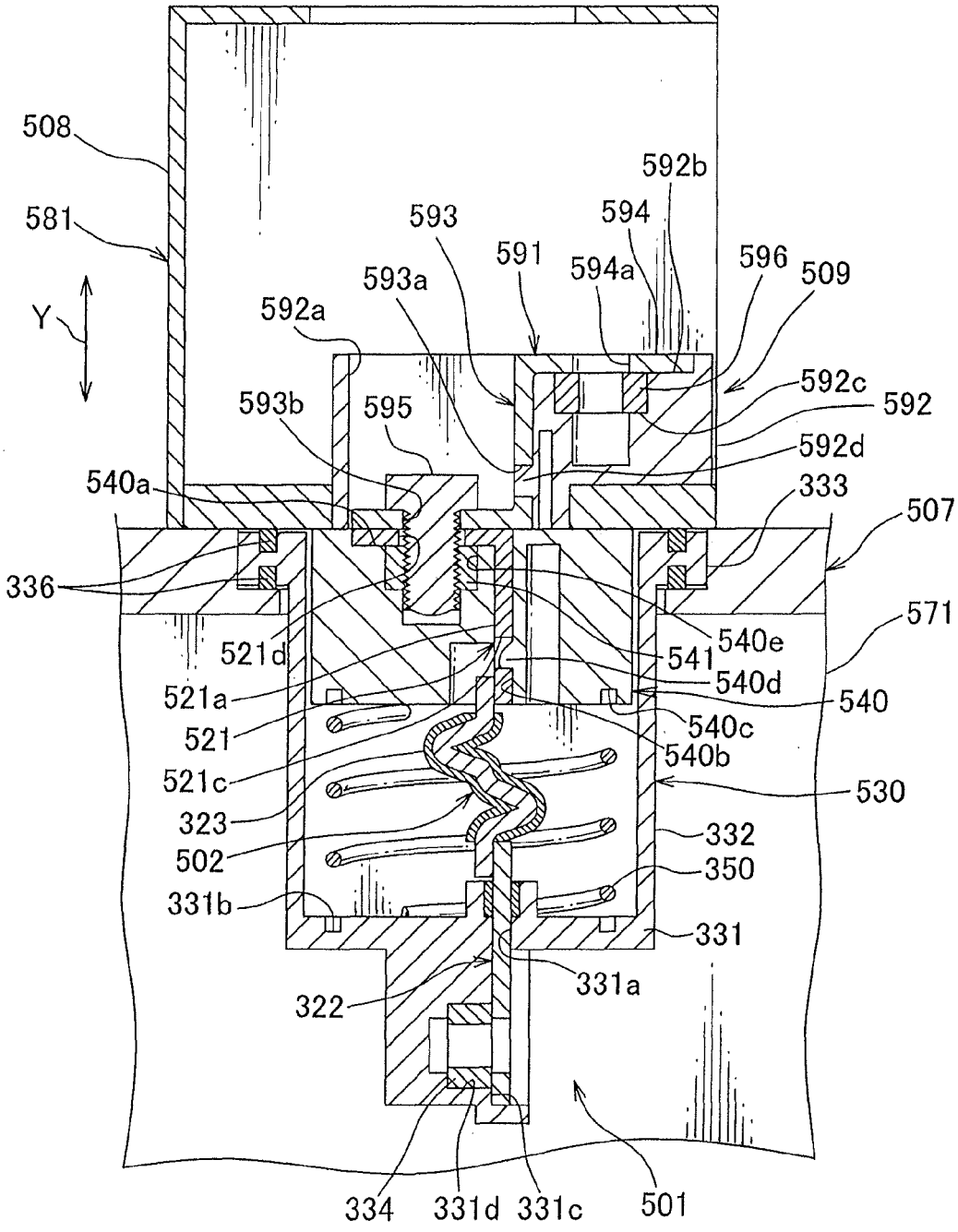
[FIG. 18] A sectional view showing a connector according to a sixth embodiment of the present invention.

As shown in FIG. 18, the connector 501 includes: a terminal 502; an inner housing 540 for receiving and holding first electric connecting part 521 of the terminal 502; an outer housing 530 provided with a receiving part 332 for movably receiving the inner housing 540 having the first electric connecting part 521 of the terminal 502 and a fixing part 331 for fixing second electric connecting part 322 of the terminal 502; and a coil spring 350 as "the biasing member".

The terminal 502 is provided with the first electric connecting part 521, a second electric connecting part 322, and a coupling part 323 coupling and electrically connecting the first electric connecting part 521 and the second connecting part 322.

The first electric connecting part 521 is made by pressing a metal plate, and provided with an L-shaped plate part 521*a* having an L-shaped cross-section. One end of the L-shaped plate part 521*a* is received in a later-described terminal receiving concave 540*a* of the inner housing 540, exposed to an outside of the connector 501, and electrically connected to the mating connector 509. A bolt hole 521*d* for bolting a terminal 591 of the mating connector 509 is provided on the one end of the L-shaped plate part 521*a*. The other end of the L-shaped plate part 521*a* perpendicular to the one end is received in a terminal receiving chamber 540*b* of the inner housing 540. A locking hole 521*c* for locking a locking arm 540*d* of the inner housing 540 is provided on the other end of the L-shaped plate part 521*a*.

The inner housing 540 is made of insulating synthetic resin. The inner housing 540 is formed in a box shape, and has a size able to be received movably in the receiving part 332 of the outer housing 530. Further, the inner housing 540 is provided with the terminal receiving chamber 540*b*, a spring receiving groove 540*c*, the terminal receiving concave 540*a*, and a bolt hole 540*e*.

The terminal receiving concave 540*a* is formed in a concave shape from an end wall facing the mating connector 509. The terminal receiving concave 540*a* receives the one end of the L-shaped plate part 521*a* of the terminal 502, and exposes one surface of the one end of the L-shaped plate part 521*a* to the outside of the connector 501.

The bolt hole 540*e* is formed in a concave shape from a bottom wall of the terminal receiving concave 540*a*, and a nut 541 is embedded in the bolt hole 540*e*. The bolt hole 521*d* of the L-shaped plate part 521*a* is overlapped with the bolt hole 540*e*.

Incidentally, before the connector 501 is fitted with the mating connector 509, the coil spring 350 is not elastically deformed, and a part of the inner housing 540 facing the mating connector 509 is projected from a surface of the case 571 of the motor 507.

The mating connector 509 includes: the terminal 591; and a synthetic resin-made housing 592. The terminal 591 is made by pressing a metal plate. The terminal 591 is integrally provided with an electric contact part 593 electrically connected to the terminal 502 of the connector 501, and a circuit connecting part 594 continued to the electric contact part 593, and electrically connected to the electric circuit of the inverter 508.

The electric contact part 593 is formed in an L-shaped section. A locking hole 593*a* for locking with a locking arm 592*d* of the housing 592 is formed on an one end of the electric contact part 593. Further, the other end of the electric contact part 593 perpendicular to the one end is exposed to an outside of the mating connector 509, and overlapped with the terminal 502 of the connector 501. A bolt hole 593*b* for overlapping with the bolt hole 521*d* of the terminal 502 is formed on the other end of the electric contact part 593. Further, when the bolt 595 is screwed into the bolt holes 521*d*, 593*d* which are overlapped with each other, the terminals 502, 591 are electrically and mechanically connected to each other.

The circuit connecting part 594 is formed in a flat plate shape, and extended from the one end of the electric contact part 593 in a separating direction from the other end of the electric contact part 593. A terminal as a component of the electric circuit of the inverter 508 is overlapped with the circuit connecting part 594. Further, a bolt hole 594*a* for overlapping with a bolt hole of the terminal is formed on the circuit connecting part 594. Further, when a bolt is screwed into the bolt holes which are overlapped with each other, the terminal 591 and the terminal as the component of the electric circuit of the inverter 508 are electrically and mechanically connected to each other.

The housing 592 is provided with a terminal receiving chamber 592*a* for receiving the electric contact part 593 of the terminal 591, a terminal receiving concave 592*b*, and a bolt hole 592*c*. A locking arm 592*d* for locking with the electric contact part 593 and attaching the electric contact part 593 into the terminal receiving chamber 592*a* is provided in the terminal receiving chamber 592*a*. Further, the other end of the electric contact part 593 received in the terminal receiving chamber 592*a* is so arranged to cover an opening of the terminal receiving chamber 592*a* facing the connector 501, and exposed to the outside of the mating connector 509. The terminal receiving concave 592*b* is formed in a concave shape from an end wall of the housing 592 away from the connector 501, and receives the circuit connecting part 594 of the terminal 591. The bolt hole 592*c* is concaved from a bottom wall of the terminal receiving concave 592*b*, and a nut 596 is embedded in the bolt hole 592*c*. The bolt hole 592*c* is overlapped with the bolt hole 594*a* of the circuit connecting part 594.

Next, a condition when the connector 501 and the mating connector 509 are fitted together will be explained. When the mating connector 509 of the inverter 508 is moved close to the connector 501 of the motor 507 along the arrow Y direction, and the electric contact part 593 of the terminal 591 is overlapped with the first electric connecting part 521 of the terminal 502, owing to an overlapping impact, the inner housing 540 is moved toward the fixing part 331, and the coil spring 350 is elastically compressed. Then, the inner housing 540 is pushed back toward the mating connector 509 owing to the elastic restoring force of the coil spring 350, and the first electric connecting part 521 and the electric contact part 593 are overlapped with each other. By fixing the first electric connecting part 521 and the electric contact part 593 overlapped with each other with the bolt 595, the terminal 502 and the terminal 591 are electrically connected to each other. Thus, the connector 501 and the mating connector 509 are fitted with each other.

According to the connector 501 of this embodiment similar to the fourth embodiment, when the terminal 591 collides with the terminal 502, the inner housing 540 is once moved toward the fixing part 331, and then pushed back due to the elastic restoring force of the coil spring 350. Therefore, the inner housing 540 is prevented from being damaged. Further, the coil spring 350 is elastically deformed to absorb the vibration. Therefore, the connection reliability between the terminal 502 and the terminal 591 of the mating connector 509 is prevented from being reduced.

(Seventh Embodiment)

A connector 601 according to a seventh embodiment of the present invention will be explained with reference to FIGS. 19 to 22.

Figure 19:
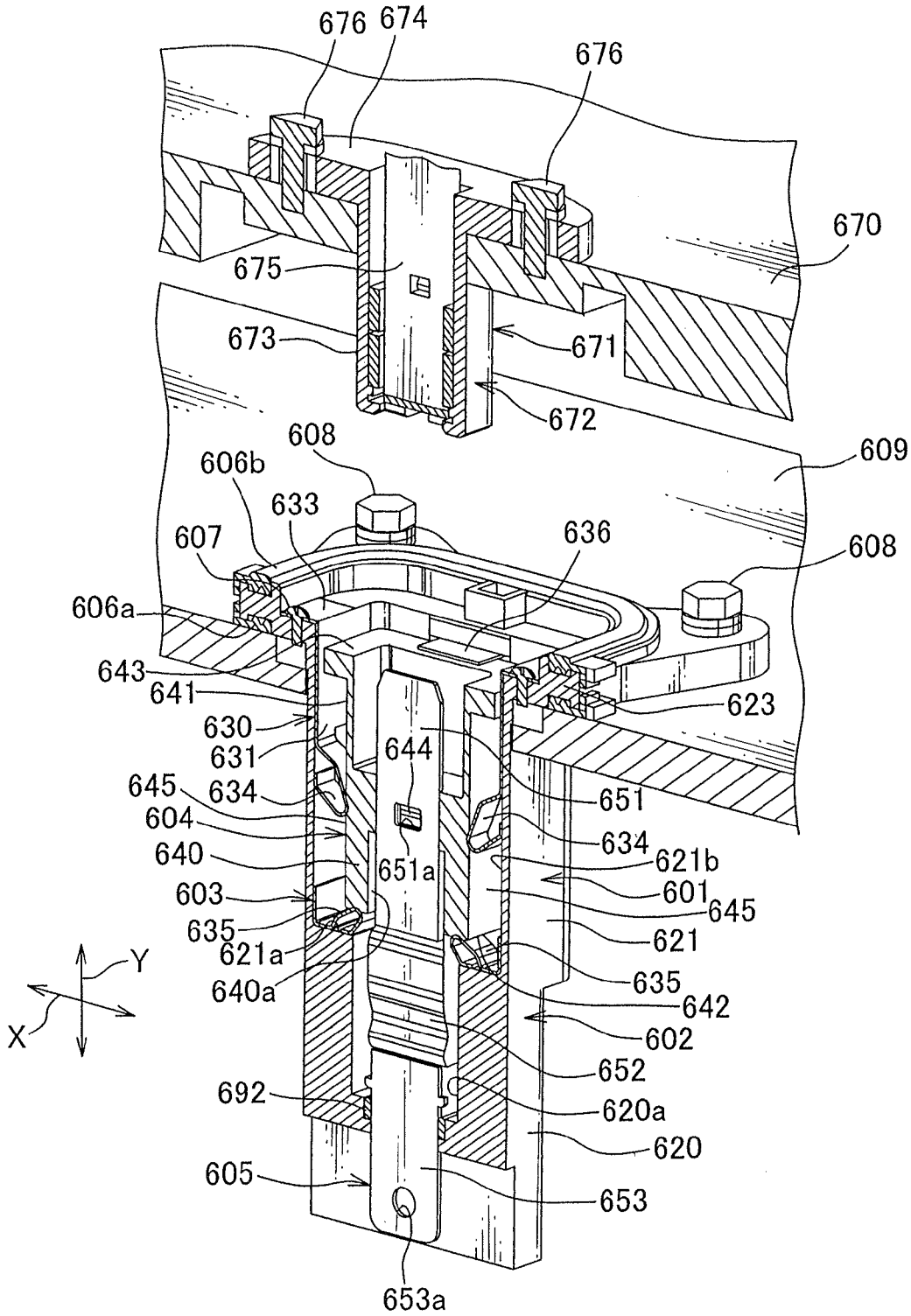
[FIG. 19] A sectional perspective view showing a connector according to a seventh embodiment of the present invention.

As shown in FIG. 19, the connector 601 is attached to a case 609 of a motor mounted on a vehicle, and fitted with, namely, electrically connected to a mating connector 671 attached to a case 670 of an inverter. Namely, when the inverter is mounted on the motor, the connector 601 is directly connected to the mating connector 671 integrally provided with the inverter.

The mating connector 671 includes: a female type terminal 675 electrically connected to an electric circuit of the inverter and electrically connected to a terminal 605 of the connector 601; and a synthetic-resin-made housing 72. Further, the housing 72 is integrally provided with a flange 674 fixed to the case 670 with a bolt 676, and a terminal receiving chamber 673 receiving the terminal 675.

Figure 20:
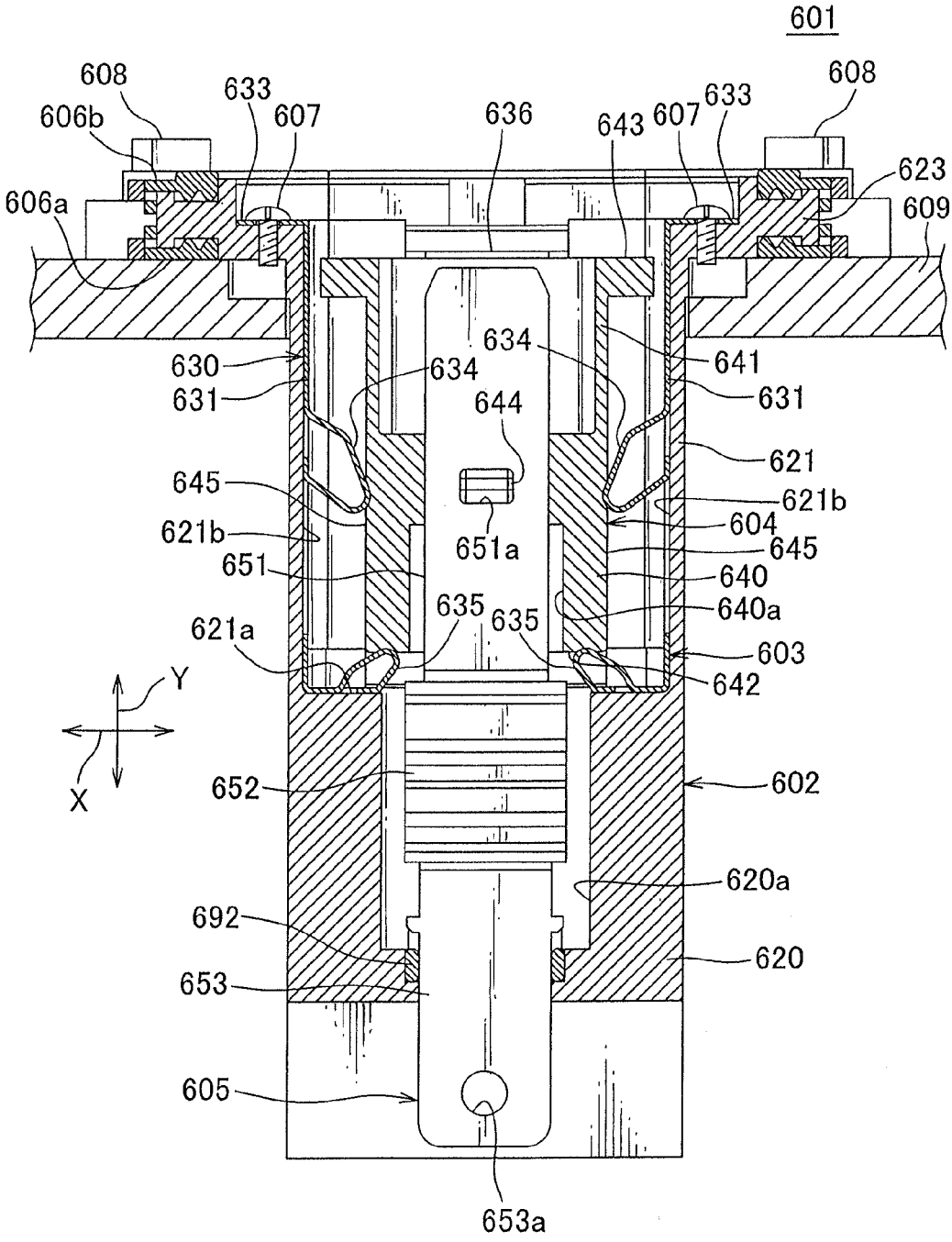
[FIG. 20] A sectional view of the connector shown in FIG. 19.

Further, an arrow Y shown in FIGS. 19 and 20 indicates a fitting direction of the mating connector 671 and the connector 601, and an arrow X indicates a direction perpendicular to the fitting direction.

As shown in FIGS. 19 and 20, the connector 601 includes: the terminal 605; an inner housing 604 for receiving and holding a later-described first electric connecting part 651 of the terminal 605; an outer housing 602 fixed to the case 609 of the motor, and receiving the terminal 605 and the inner housing 604; a holder 603 attached to the outer housing 602 and attaching the inner housing 604 into the outer housing 602 movably in all directions; and packings 606*a*, 606*b*, 692.

The terminal 605 is provided with the first electric connecting part 651, a second electric connecting part 653, and a coupling part 652.

The first electric connecting part 651 is made of conductive metal, and formed in a plate shape, namely, a male type. The first electric connecting part 651 is inserted into, namely, fitted into an inside of the female type terminal 675 of the mating connector 671 to be electrically connected to the terminal 675. Further, a locking hole 651*a* for locking with a later-described locking member 644 of the inner housing 604 is formed on the first electric connecting part 651.

The second electric connecting part 653 is made of conductive metal, and formed in a plate shape. The second electric connecting part 653 is electrically connected to the electric circuit in the case 609 of the motor. Further, a circular hole 653*a* though which a bolt is inserted for fixing the second electric connecting part 653 to the electric circuit of the motor is formed on the second electric connecting part 653.

The coupling part 652 is made of a flexible conductive braided wire. The coupling part 652 is interposed between the first electric connecting part 651 and the second electric connecting part 653 to electrically connect the first electric connecting part 651 and the coupling part 652 movably to each other. Further, the coupling part 652, the first electric connecting part 651, and the second electric connecting part 653 are electrically connected to each other by ultrasonic bonding.

In such a terminal 605, because the first electric connecting part 651 and the second electric connecting part 653 are electrically connected to each other by the deformable coupling part 652, while the second electric connecting part 653 is fixed, the first electric connecting part 651 can be moved freely.

The inner housing 104 is made of synthetic resin. The inner housing 604 is integrally provided with a terminal receiving part 641 having a rectangular tubular shape with a closed end for receiving a tip end of the first electric connecting part 651 of the terminal 605 away from the coupling part 652, and a terminal attaching part 640 extended from a bottom wall of the terminal receiving part 641 to a far side from an opening of the terminal receiving part 641 for attaching a rear end part of the first electric connecting part 651 near the coupling part 652. Further, a gap is formed between an inner side wall of the terminal receiving part 641 and the first electric connecting part 651 for receiving a terminal receiving part 673 of the mating connector 671 which is inserted into the opening of the terminal receiving part 641.

When the terminal receiving part 673 is fitted into the gap of the terminal receiving part 641, the first electric connecting part 651 is received in the terminal 675 of the mating connector 671.

Further, the terminal attaching part 640 is provided with a though hole 640*a* communicating with an inner space of the terminal receiving part 641 for guiding the rear end part of the first electric connecting part 651, and the locking member 644 for locking with the above-described locking hole 651*a* of the first electric connecting part 651. When the locking member 644 is locked with the locking hole 651*a*, the first electric connecting part 651 is attached to the terminal attaching part 640.

Further, a reference numeral 643 shown in FIG. 20 or the like indicates "a front end wall" of the inner housing 604. A reference numeral 642 indicates "a rear end wall" of the inner housing 604. Further, a reference numeral 645 indicates "an outer side wall" of the inner housing 604. Thus, according to the present invention, an end wall on which the terminal receiving part 641 of the inner housing 604 is provided is referred to as the "front end wall 643", and an end wall on which the terminal attaching part 640 of the inner housing 604 is provided is referred to as the "rear end wall 642". Further, the though hole 640*a* faces in a direction of the rear end wall 642 of the inner housing 604 to allow the rear end portion of the first electric connecting part 651 to be projected from the rear end wall 642.

The outer housing 602 is made of synthetic resin. The outer housing 602 is integrally provided with a receiving part 621 having a rectangular tubular shape with a closed end and opened forward, namely, toward the mating connector 671, a flange 623 extended in a flange shape from an end at the opening of the receiving part 621 to an outside of the receiving part 621, and a fixed part 620 extended from a bottom wall 621*a* of the receiving part 621 to a direction away from the opening of the receiving part 621.

The inner housing 604 is received in the receiving part 621 in a manner that the front end wall 643 of the inner housing 604 is positioned at the opening of the receiving part 621, and the rear end wall 642 of the inner housing 604 is positioned at the bottom wall 621*a*. An inner diameter of the receiving part 621 is larger than an outer diameter of the inner housing 604. Further, a depth in an arrow Y direction of the receiving part 621 is longer than a whole length in the Y direction of the inner housing 604. Thus, the receiving part 621 receives the inner housing 604 movably in all directions.

The flange 623 is overlapped with an outer surface of the case 609, and fixed to the case 609 with a bolt 608. Further, the packing 606*a* is attached between the flange 623 and the outer surface of the case 609. This packing 606*a* keeps a boundary between the flange 623 and the outer surface of the case 609 watertight. Further, a packing 606*b* is attached between the flange 623 and an outer surface of the case 670 of the inverter. This packing 606*b* keeps a boundary between the flange 623 and the outer surface of the case 670 watertight. Further, these packings 606*a*, 606*b* are provided in a ring shape along a whole circumference of the flange 623, namely, a whole circumference of the outer housing 602.

The fixed part 620 is provided with a through hole 620*a* communicating with an inner space of the receiving part 621 for receiving the coupling part 652 and the second electric connecting part 653 of the terminal 605. Further, the though hole 620*a* faces in a direction of a rear end wall of the fixed part 620 away from the receiving part 621 to allow the rear end portion of the second electric connecting part 653 to be projected from the rear end wall of the fixed part 620. Further, as described above, the rear end part of the second electric connecting part 653 projected from the rear end wall of the fixed part 620 is electrically connected to the electric circuit of the motor when a bolt is inserted into the circular hole 653*a*.

Further, a ring-shaped packing 692 is attached to the center in the longitudinal direction of the second electric connecting part 653 for keeping a boundary between an inner wall of the through hole 620*a* and the second electric connecting part 653 watertight by closely contacting the inner wall of the through hole 620*a*. When the packing 692 is attached to the outer periphery of the second electric connecting part 653 and pushed into the through hole 620*a*, the second electric connecting part 653 is fixed to the fixed part 620.

Figure 21:
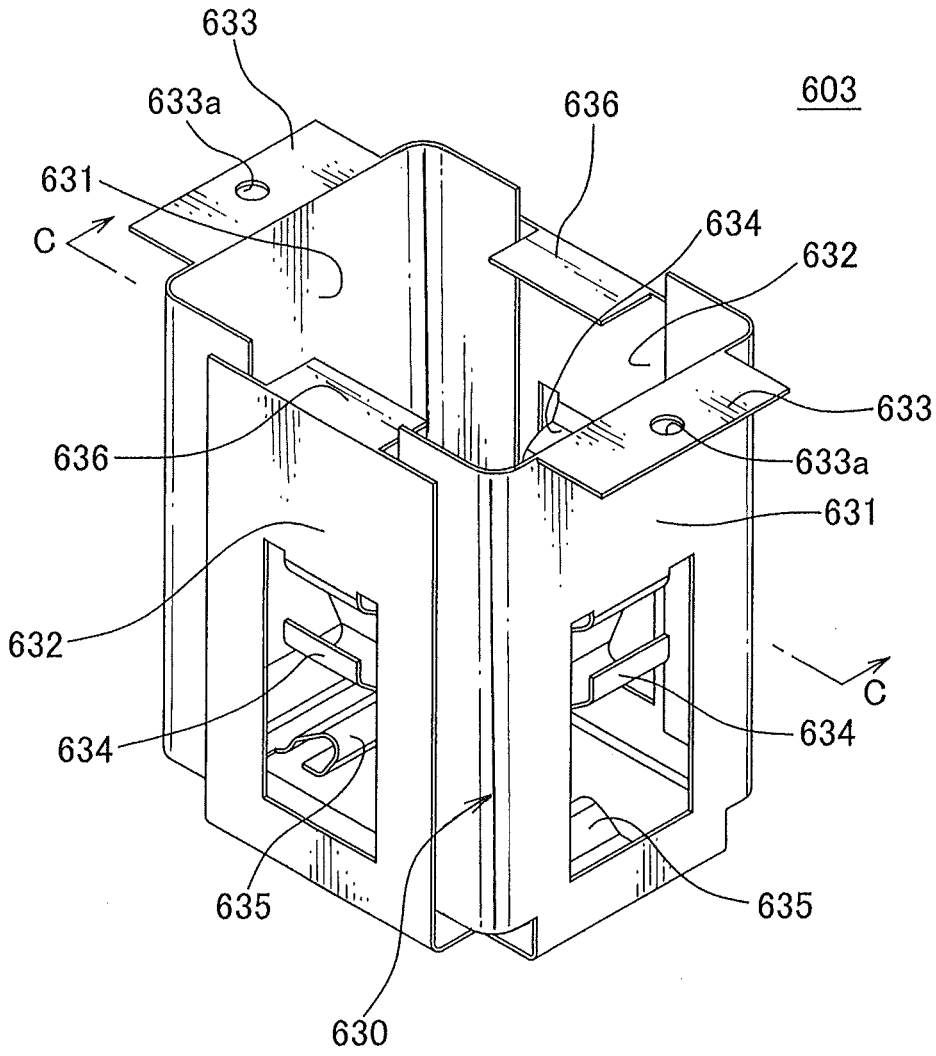
[FIG. 21] A perspective view of a holder shown in FIG. 19.
Figure 22:
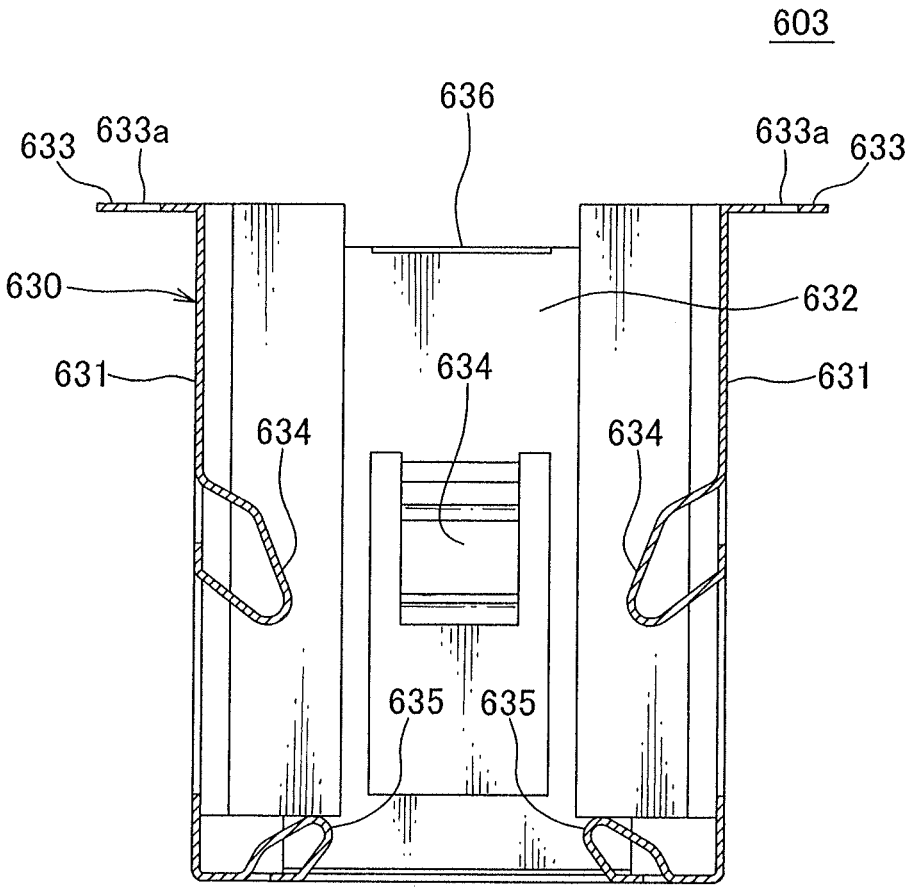
[FIG. 22] A sectional view taken on line C-C of FIG. 21.

The holder 603 is made by pressing a thin metal plate. As shown in FIGS. 21 and 22, the holder 603 is integrally provided with a tube part 630, four first springs 634 as "the biasing part", two second springs 635 as "the second biasing part" or "the biasing member", two stoppers 636, and two flanges 633.

The tube part 630 is formed in a rectangular tubular shape with a pair of walls 631 facing each other, and a pair of walls 632 facing each other. The inner housing 604 is positioned in an inside of the tube part 630.

The four first springs 634 are made by cutting and pulling upward partially one sides of walls 631, 632 of the tube part 630 in a band shape, and by bending them in a U-shape so as to project toward an inside of the tube part 630.

The two second springs 635 are formed by cutting and pulling upward partially one sides of walls 631 of the tube part 630 in a band shape, and by bending them in a U-shape so as to project toward the inside of the tube part 630 and the other ends of the tube part 630.

The two stoppers 636 are extended from the other ends of the pair of walls 631 of the tube part 630. The two stoppers 636 are made by folding the extended portion so as to abut on, namely, overlap the front end wall 643 of the inner housing 604 after the inner housing 604 is inserted into the tube part 630 from an opening at the other end of the tube part 630.

The two flanges 633 are made by extending from the other end of the pair of walls 631 and by folding toward an outside of the tube part 630. Further, the flange 633 is provided with a circular hole 633*a* through which the bolt 607 is inserted. The flange 633 is overlapped with the flange 623 of the outer housing 602, and fixed to the flange 623 with the bolt 7 inserted into the circular hole 633*a*.

When the holder 603 is inserted into the receiving part 621 from the opening of the receiving part 621 in a direction that an outer surface of the tube part 630 faces an inner side wall 621*b* of the receiving part 621, the holder 603 is attached to the outer housing 602. Further, in a condition that the inner housing 604 is received in an inside of the tube part 630, and attached to the outer housing 602, the four first springs 634 of the holder 603 disposed in a manner to surround the inner housing 604 push outer side walls 645 of the inner housing 604 toward the inner side walls 621*b* of the receiving part 621 in an arrow X direction. Namely, the four first springs 634 push the inner housing 604 toward the center of the inner housing 604. Further, two second springs 635 interposed between the fixed part 620 and the rear end wall 642 of the inner housing 604 push the rear end wall 642 of the inner housing 604 toward the opening of the receiving part 621. Further, when the two second springs 635 push the inner housing 604 toward the opening of the receiving part 621, the front end wall 643 of the inner housing 604 abuts on the two stoppers 636. Further, these two stoppers 636 prevent the inner housing 604 from falling out of the receiving part 621 via the opening of the receiving part 621.

Namely, when the inner housing 604 and the first electric connecting part 651 are moved in the arrow X direction, the first spring 634 of the holder 603 is elastically deformed. Further, when the inner housing 604 and the first electric connecting part 651 are moved in the arrow Y direction, the second spring 635 is elastically deformed. Thus, the holder 603 attaches the inner housing 604 to the receiving part 621 of the outer housing 602 movably in all directions.

According to the connector 601 having above-described structure, when fitting with the mating connector 671, the first spring 634 and the second spring 635 are elastically deformed as the first electric connecting part 651 is inserted into the terminal 675 of the mating connector 671, thereby the inner housing 604 is moved in the receiving part 621 of the outer housing 602 to absorb a position gap generated between the terminal 675 of the mating connector 671 and the first electric connecting part 651.

Further, according to the connector 601 having above-described structure, an impact load applied to the inner housing 604 by fitting the connector 601 and the mating connector 671 together can be absorbed by an elastic deformation of the second spring 635. This prevents the inner housing 604 from colliding with the bottom wall 621*a* of the receiving part 621, namely, the fixed part 620 and from being damaged. Incidentally, the impact load applied to the inner housing 604 when fitting together with the mating connector 671 integrated with the inverter is very large because the weight of the inverter is added. Further, by the elastic restoring force of the second spring 635, the inner housing 604 is pushed back toward the mating connector 671. Then, the stopper 636 abuts on the front end wall 643 of the inner housing 604 to hold the front end wall 643, thereby the inner housing 604 is prevented from falling out of the receiving part 621 via the opening of the receiving part 621.

Further, according to the connector 601 having above-described structure, the first spring 634 and the second spring 635 absorb a vibration of the case 609 generated by driving the motor or the like to prevent the vibration from transmitting to the inner housing 604.

Further, according to the connector 601 having above-described structure, the second electric connecting part 653 is electrically connected to the first electric connecting part 651 via the coupling part 652 composed of the braided wire. Therefore, even when the inner housing 604 and the first electric connecting part 651 are moved by fitting with the mating connector 671, the second electric connecting part 653 is not moved. Thereby, in a member electrically connected to the second electric connecting part 653, a stress is prevented from generating. Further, connection reliability between the second electric connecting part 653 and the member is prevented from being reduced. In this manner, according to the present invention, because the connector 601 includes the holder 603 integrally provided with the tube part 630, the first spring 634, the second spring 635, and the stopper 636, when fitting with the mating connector 671, the position gap generated between the terminal 605 and the terminal 675 of the mating connector 671 is absorbed to surely fit with the mating connector 671. Further, the terminal 605, the inner housing 604, and the outer housing 602 are prevented from being damaged due to the impact when colliding with the mating connector 671. Further, the inner housing 604 is prevented from falling out of the receiving part 621, and the vibration can be absorbed. Further, the connector 601 having a small number of components and a simple structure can be provided. Further, because the stopper 636 is made by folding the extended portion so as to abut on the front end wall 643 of the inner housing 604 after the inner housing 604 is inserted into the tube part 630, compared with a case using "a stopper assembled with an outer housing after an inner housing is received in the outer housing", the outer housing 602 and the stopper 636 can be in a simple shape.

Further, in the embodiment described above, the example that the connector 601 is fixed to the case 609 of the motor is explained. However, the connector of the present invention may be fixed to any case.

Further, in the embodiment described above, the coupling part 652, the first electric connecting part 651, and the second electric connecting part 653 are electrically connected to each other by ultrasonic bonding. However, according to the present invention, the coupling part 652, the first electric connecting part 651, and the second electric connecting part 653 are electrically connected to each other by crimping with a tool. Further, the coupling part of the present invention is not limited to the braided wire, but may be anything as long as an elastic or flexible conductive material.

Further, according to the present invention, at least two "first springs" may be provided, and more than four "first springs" can be provided. Further, at least one "second spring" and at least one "stopper" may be provided, and more than two "second springs" and more than two "stoppers" can be provided.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

Reference Signs List

1, 101, 201, 301, 401, 501, 601 connector
2, 102, 202, 302, 502, 605 terminal
5, 104, 204, 340, 440, 540, 604 inner housing
8, 111, 309, 509, 671 mating connector
21, 121, 221, 321, 521, 651 first electric connecting part
22, 122, 222, 322, 653 second electric connecting part
23, 120, 220, 323, 652 coupling part
30, 108, 203, 330, 430, 530, 602 outer housing
35, 134, 234, 331, 431, 620 fixing part
36, 130, 230, 332, 621 receiving part

The invention claimed is:

1. A connector comprising:
a terminal;
an inner housing; and
an outer housing receiving the terminal and the inner housing,
wherein the terminal is provided with a first electric connecting part received and held in the inner housing, and electrically connected to a mating connector, a second electric connecting part disposed further away from the mating connector than the first electric connecting part, and a coupling part made of conductive material, having flexibility or elasticity, and movably coupling and electrically connecting the first electric connecting part and the second connecting part,
wherein the outer housing is provided with a receiving part movably receiving the inner housing receiving the first electric connecting part, and a fixing part to which the second electric connecting part is fixed, and
wherein the coupling part is composed of a braided wire.

2. The connector as claimed in claim 1, further comprising: a biasing member interposed between the fixing part and the inner housing, and configured to bias the inner housing toward the mating connector.

3. The connector as claimed in claim 2, wherein the biasing member is composed of a coil spring.

4. The connector as claimed in claim 3, further comprising: a tubular holder attached to an inside of the receiving part and configured to receive the inner housing.

5. The connector as claimed in claim 2, wherein the biasing member is made of rubber, and formed in a tubular shape, and
wherein the coupling member is positioned at an inside of the biasing member.

6. The connector as claimed in claim 2, further comprising: a tubular holder attached to an inside of the receiving part and configured to receive the inner housing.

7. The connector as claimed in claim 1, further comprising: a tubular holder attached to an inside of the receiving part and configured to receive the inner housing.

8. The connector as claimed in claim 7, wherein the holder is attached to the inside of the receiving part movably in a direction perpendicular to a fitting direction with the mating connector.

9. The connector as claimed in claim 7, wherein a biasing part configured to bias the inner housing toward an inner side wall of the receiving part is provided on the holder.

10. The connector as claimed in claim 7, wherein a stopper configured to prevent the inner housing from falling out of the receiving part is provided on the holder.

11. The connector as claimed in claim 7, wherein the holder is made of metal.

12. The connector as claimed in claim 7, wherein the holder is made by pressing a metal plate, and
wherein the holder is integrally provided with a tube part formed in a tubular shape, and configured to receive the inner housing, a biasing part made by partially cutting the tube part and bending inward of the tube part, and configured to bias the inner housing toward an inner side wall of the receiving part, a second biasing part made by extending from one end of the tube part and bending toward the mating connector at an inside of the tube, interposed between the fixing part and the inner housing, and configured to bias the inner housing toward the mating connector, and a stopper made by extending from the other end of the tube part, and bending so as to cover an end wall of the inner housing at the mating connector side after the inner housing is inserted into the tube part via an opening at the other end side of the tube part, and configured to prevent the inner housing from falling out of the receiving part.

13. The connector as claimed in claim 7, wherein the inner housing is provided with an inner housing main body configured to receive the first electric connecting part, and an elastic arm continued to an outer wall of the inner housing main body and configured to elastically abut on an inner wall of the holder.

14. The connector as claimed in claim 1, wherein the inner housing is received in the receiving part movably in the all directions.

15. The connector as claimed in claim 1, further comprising: a tubular holder attached to an inside of the receiving part and configured to receive the inner housing.

16. A connector comprising:
a terminal;
an inner housing; and
an outer housing receiving the terminal and the inner housing,
wherein the terminal is provided with a first electric connecting part received and held in the inner housing, and electrically connected to a mating connector, a second electric connecting part disposed further away from the mating connector than the first electric connecting part, and a coupling part made of conductive material, having flexibility or elasticity, and movably coupling and electrically connecting the first electric connecting part and the second connecting part, wherein the outer housing is provided with a receiving part movably receiving the inner housing receiving the first electric connecting part, and a fixing part to which the second electric connecting part is fixed, wherein the coupling part is made by pressing a metal plate, formed elastically deformable in all directions, and composed of a first circular part attached to the first electric connecting part, a second circular part attached to the second electric connecting part, and a plurality of bow-shaped parts of which one end is continued to the first circular part, and the other end is continued to the second circular part and formed in a band shape, and of which intermediate part between the first and second circular parts is bend in a bow shape, and wherein because the coupling part is elastically deformed, the coupling part couples the first and second electric connecting parts movably in all directions.

17. The connector as claimed in claim 16, further comprising: a tubular holder attached to an inside of the receiving part and configured to receive the inner housing.

18. A connector comprising:

a terminal;

an inner housing; and an outer housing receiving the terminal and the inner housing, wherein the terminal is provided with a first electric connecting part received and held in the inner housing, and electrically connected to a mating connector, a second electric connecting part disposed further away from the mating connector than the first electric connecting part, and a coupling part made of conductive material, having flexibility or elasticity, and movably coupling and electrically connecting the first electric connecting part and the second connecting part, wherein the outer housing is provided with a receiving part movably receiving the inner housing receiving the first electric connecting part, and a fixing part to which the second electric connecting part is fixed, and wherein the coupling part is composed of a coil spring.

19. The connector as claimed in claim 18, further comprising: a tubular holder attached to an inside of the receiving part and configured to receive the inner housing.

* * * * *